US012508468B2

(12) United States Patent
Prospero et al.

(10) Patent No.: US 12,508,468 B2
(45) Date of Patent: Dec. 30, 2025

(54) ELASTIC RESISTANCE SUPPORT

(71) Applicants: Marina Prospero, Toronto (CA); Collon Brown, Toronto (CA)

(72) Inventors: Marina Prospero, Toronto (CA); Collon Brown, Toronto (CA)

( * ) Notice: Subject to any disclaimer, the term of this patent is extended or adjusted under 35 U.S.C. 154(b) by 266 days.

(21) Appl. No.: 18/295,646

(22) Filed: Apr. 4, 2023

(65) Prior Publication Data

US 2023/0241441 A1 Aug. 3, 2023

Related U.S. Application Data

(63) Continuation-in-part of application No. 17/498,461, filed on Oct. 11, 2021, now abandoned, which is a continuation-in-part of application No. 15/876,003, filed on Jan. 19, 2018, now abandoned.

(60) Provisional application No. 62/507,624, filed on May 17, 2017, provisional application No. 62/448,128, filed on Jan. 19, 2017.

(51) Int. Cl.
*A63B 21/00* (2006.01)
*A63B 21/055* (2006.01)

(52) U.S. Cl.
CPC ..... *A63B 21/4005* (2015.10); *A63B 21/0552* (2013.01); *A63B 21/4007* (2015.10); *A63B 21/4011* (2015.10); *A63B 2225/09* (2013.01)

(58) Field of Classification Search
CPC ..... A63B 21/4011; A63B 21/4007; A63B 21/0552; A63B 21/0557; A63B 21/4005; A63B 21/4035; A63B 21/02; A63B 21/04; A63B 21/0407; A63B 21/0442; A63B 21/055; A63B 21/0555; A63B 21/06515; A63B 21/40; A63B 21/4001; A63B 21/4025; A63B 2225/09; A63B 69/0057; A63B 69/0059; A63B 69/0062; A63B 71/08; A63B 71/1225; A63B 2071/1241
See application file for complete search history.

(56) References Cited

U.S. PATENT DOCUMENTS 3,937,461 A 2/1976 Lew
4,911,439 A * 3/1990 Kuhl ..... A63B 21/4025 482/124
5,993,362 A * 11/1999 Ghobadi ..... A63B 21/4015 482/121

(Continued)

OTHER PUBLICATIONS

Prospero, "Instruction Manual", Dec. 2012, retrieved on Jul. 2019, 8 pages, issuu.com/marinaprospero/docs/perfectore.instruction.

(Continued)

*Primary Examiner* — Megan Anderson
*Assistant Examiner* — Kathleen M Fisk

(57) ABSTRACT

When a body in movement is weak and out of alignment it is prone to more injury, and such injury usually takes place in the overextension of muscles and joints, particularly manifesting in the spine during bending and lifting. This translates into a decrease that affects performance, efficiency, strength, stamina and endurance. The present invention provides a solution by encapsulating the body in an elastic resistance fully flexible support that provides structure to muscles and joints, reducing over extension and harnessing collective muscular cooperations to help all the muscles work together.

19 Claims, 29 Drawing Sheets

(56) References Cited

U.S. PATENT DOCUMENTS

| | | | | |
|---|---|---|---|---|
| 7,356,849 | B2 * | 4/2008 | Morrow | A61F 5/0118 2/16 |
| D635,624 | S | 4/2011 | Brown et al. | |
| 2008/0076645 | A1 | 3/2008 | Brown | |
| 2024/0024732 | A1 * | 1/2024 | Smith | A63B 21/0552 |

OTHER PUBLICATIONS

Issuu, "Backizer", Dec. 2012, retrieved on Jun. 2019, 5 pages, https://issuu.com/marinaprospero/docs/packcizer_info_kit.

* cited by examiner

ELASTIC RESISTANCE SUPPORT

The current application is a continuation in part of a U.S. non-provisional application Ser. No. 17/498,461 filed on Oct. 11, 2021. The application Ser. No. 17/498,461 is a continuation application of a U.S. non-provisional application Ser. No. 15/876,003 filed on Jan. 19, 2018. The U.S. non-provisional application Ser. No. 15/876,003 claims a priority to the U.S. Provisional Patent application Ser. No. 62/448,128 filed on Jan. 19, 2017 and a priority to the U.S. Provisional Patent application Ser. No. 62/507,624 filed on May 17, 2017.

FIELD OF THE INVENTION

The present invention generally relates to an elastic resistance support. More precisely, the present invention is an elastic resistance support utilizing an elastic tube mounted onto an anchor plate that applies consistent resistance to the upper and lower body to improve stability, spinal alignment, and posture.

BACKGROUND OF THE INVENTION

Spinal alignment is one of the most vital aspects of human wellness. As such, the present invention is an elastic resistance support capable of limiting movements of the user to protect the user from overextension, protecting them from injury. The elastic resistance support also engages muscles collectively, increasing strength and engaging core power resulting in improved physical performance.

The ergonomic design of the elastic resistance support uses the properties of opposing forces to balance the body by supporting the vertebrae of the spine. The shoulder loops help to retract the scapula, resulting in the expansion of the chest. These applied opposing forces shift the body, balancing the head in a neutral posture with improved center of gravity. As this happens, core muscles are engaged, holding the body erect. This effortlessly aligns and supports posture with the aim of relieving neck, back, and shoulder strain. In particular, the elastic resistance support uses a mid-back support cushion that adjusts and holds the user's body in proper spinal alignment by supporting the thoracic vertebrae and ergonomically preventing the user from collapsing forward.

The elastic resistance support affords many health benefits to the users, including but not limited to:

- Sitting and standing in an erect posture with proper spinal alignment
- Relieving excess strain from the back, neck, and shoulders
- Improving balance and equilibrium
- Strengthening physical structure
- Protecting the user from over extension of spine and joints
- Supporting the body from collapse
- Improving stability, strength and stamina
- Improving gait and movement
- Offering structural assistance in lifting and bending To achieve said benefits, the elastic resistance support improves the body's center of gravity by causing a spinal righting reflex. An anchor plate in combination with a thoracic support cushion acts as a pivot point, adjusting and holding the thoracic vertebrae in correct alignment, resulting in better posture while sitting, standing, or moving.

The elastic resistance support can be put on and easily adjusted to fit any size of the user's body. It ergonomically conforms to the body's shape, allowing for full flexibility and range of motion. The elastic tube stretches to generate differing amounts of resistance applied to the body. The elastic tubes act as resistance bands to provide a force against which the muscles must work. This action causes the muscles to contract, which stimulates bone as well as muscle growth. The use of resistance bands is a safe method to increase strength, rehabilitate injury, and help prevent muscular deterioration. Furthermore, stretching with therapeutic elastic resistance can tone muscle. While using the elastic resistance support, the user can increase circulation, flexibility, and range of motion.

One of the main concerns in physical activity—whether recreational or occupational in nature—is protection from injury. Individuals are always looking for a way to reduce risk of harm. The elastic resistance support is designed to solve this problem of overextension due to poor physical structure. The elastic resistance support aims to create a device that can protect the user from harm during physical activity.

An objective of the present invention is to provide an elastic resistance support that can be worn by the user while participating in a range of physical activities. Such activities may include, for example, standing, running, walking, jumping and lifting objects. The elastic resistance support is ergonomically shaped to provide a comfortable and adjustable fit. Additionally, the elastic resistance support is uniquely designed so that the elastic resistance support is held securely in place on the user's body. The intensity of resistance is controlled by the user's movements. Any movements performed by the user while wearing the elastic resistance support help to strengthen the muscles that are used in the movement. The elastic property of the elastic resistance support allows the elastic resistance support to expand and contract during movements such as eccentric strength training.

The elastic resistance support can be used to enhance performance while training in fitness and sports. Eccentric training is used for power development. During a jump, a user's quadriceps shorten, or contract concentrically when the user extends their legs. The user's hamstrings control the return movement. As they contract concentrically, the user's quads lengthen and contract eccentrically. Elastic energy that powers the next jump is stored during eccentric contraction. This provides a means to improve form, increase power, muscular endurance, stamina and strength. Elastic resistance strength training adds resistance during the eccentric or lengthening phase of the movement. Elastic resistance is a unique type of resistance training compared to other traditional forms, such as isotonic or isokinetic resistances. The resistance is based on the amount that the elastic resistance support is stretched. This resistance can be measured in pounds of force depending on the percentage the tubing is stretched from its resting length; this is known as "force-elongation". Additionally, the freedom of movement afforded by the elastic resistance support allows the user to simulate athletic specific movement patterns. The benefits of using the elastic resistance support include: increasing of strength and power, improving body function, decreasing of pain, improvement of balance and proprioception, improvement of posture, gait and cardiovascular fitness, and decreasing of injury, disability, and the prevention of deterioration.

DETAILED DESCRIPTION OF THE INVENTION

All illustrations of the drawings are for the purpose of describing selected versions of the present invention and are not intended to limit the scope of the present invention.

Figure 1:
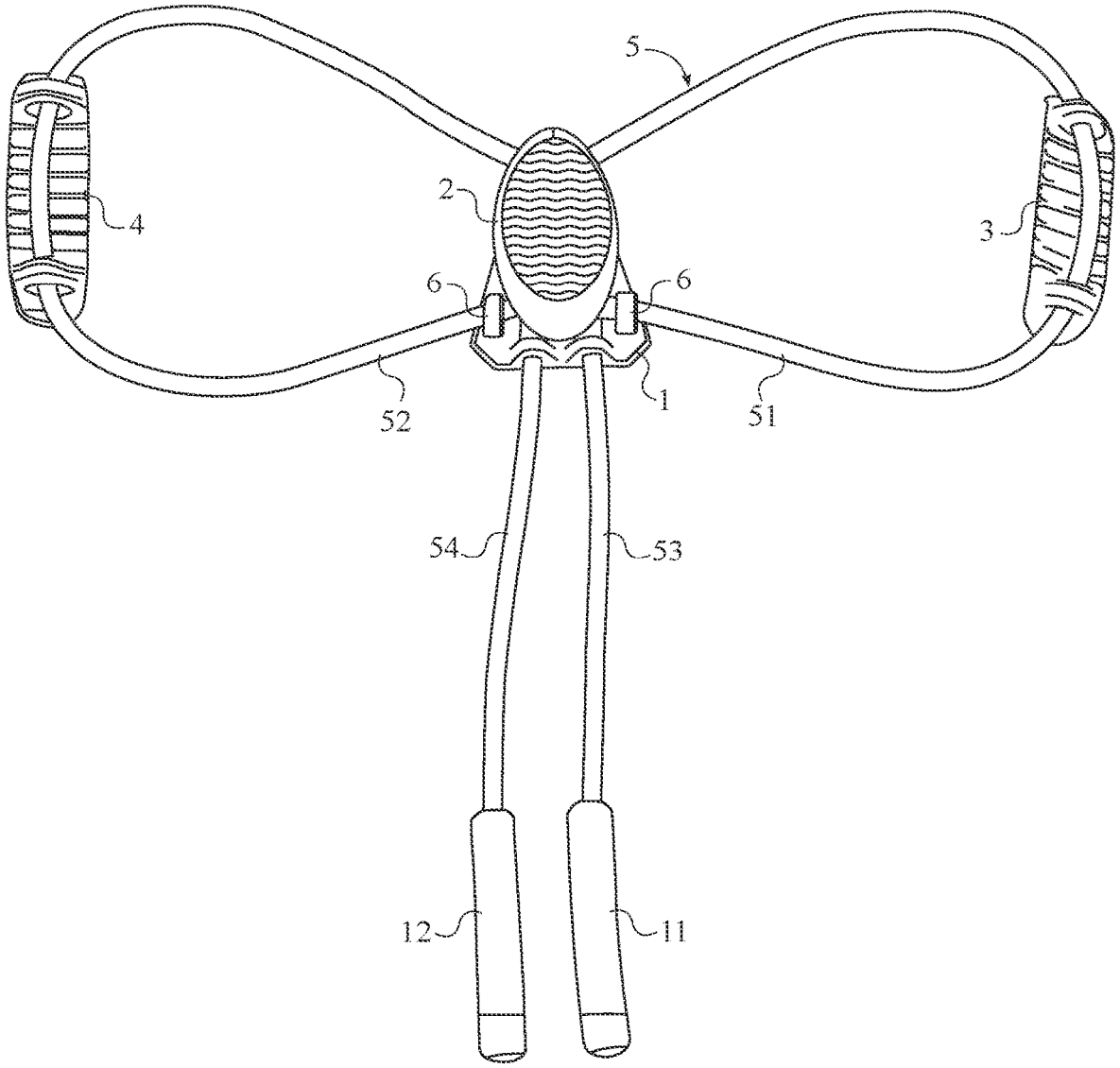
FIG. 1 is a front view of the present invention.
Figure 10:
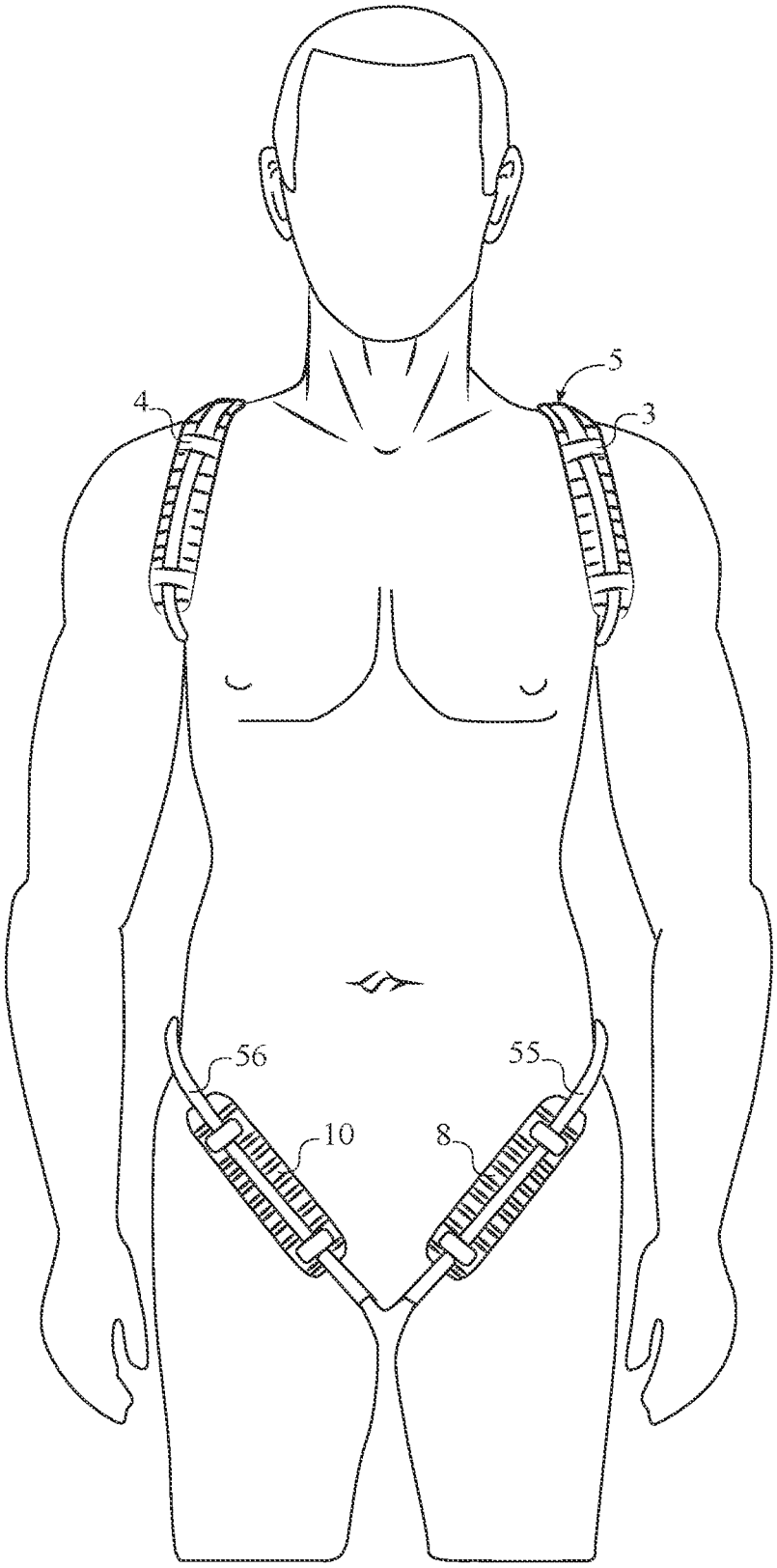
FIG. 10 is a front view of the present invention, in an alternate operative configuration, worn by a male user.
Figure 11:
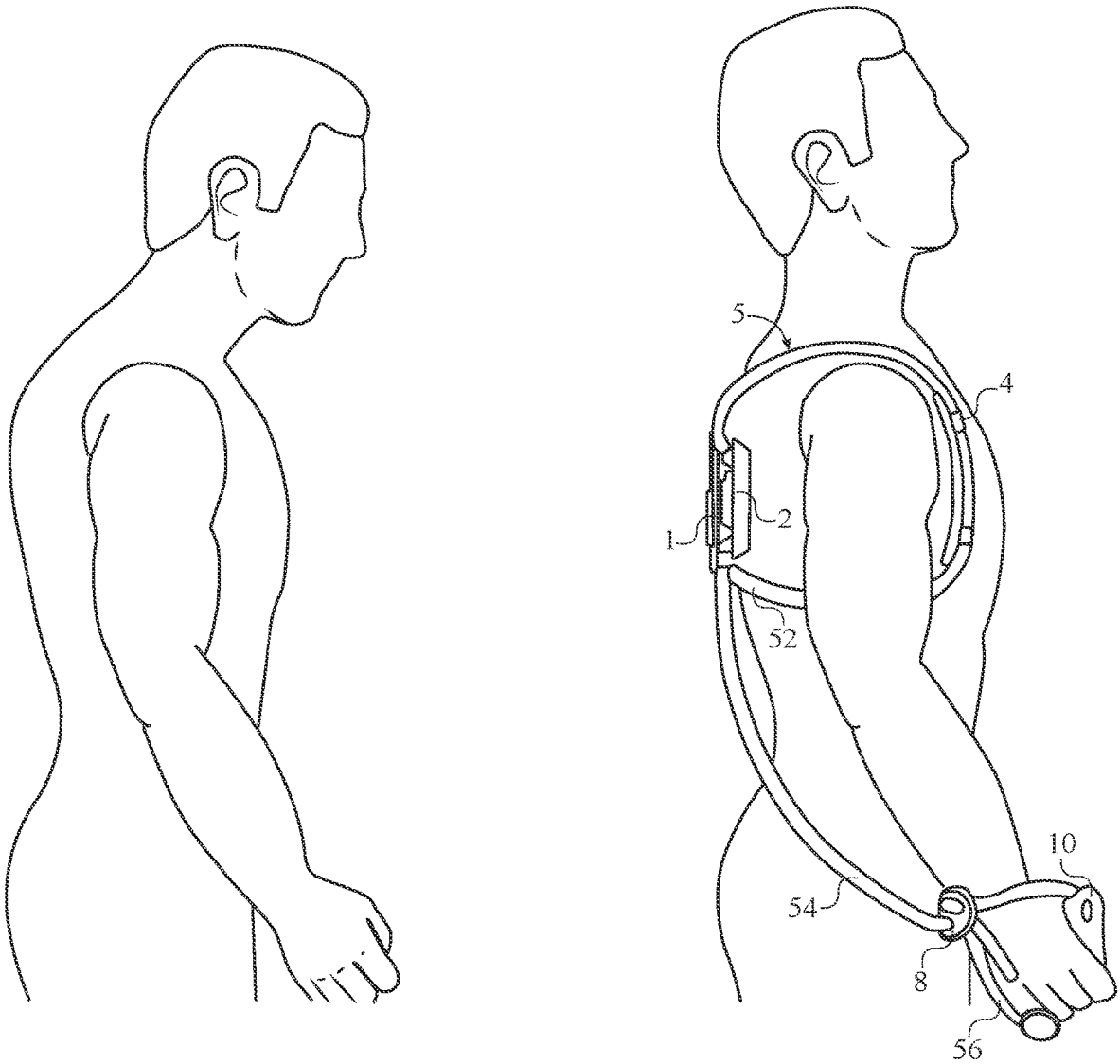
FIG. 11 is a right-side view of the present invention worn by a user illustrating the user's improved posture.
Figure 12:
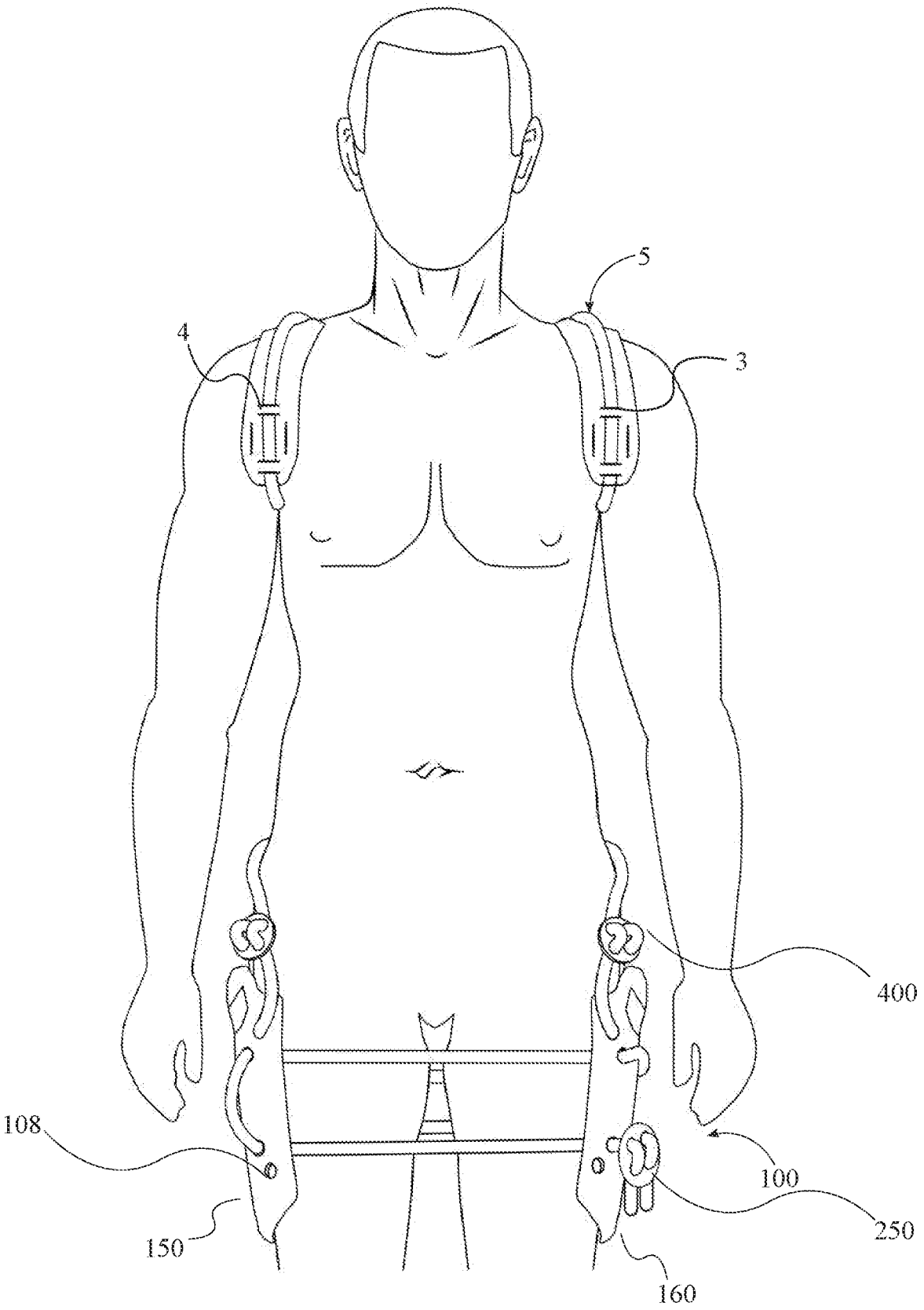
FIG. 12 is a front view of the present invention with both the leg pads and shoulder pads in an operative configuration worn by a user.
Figure 13:
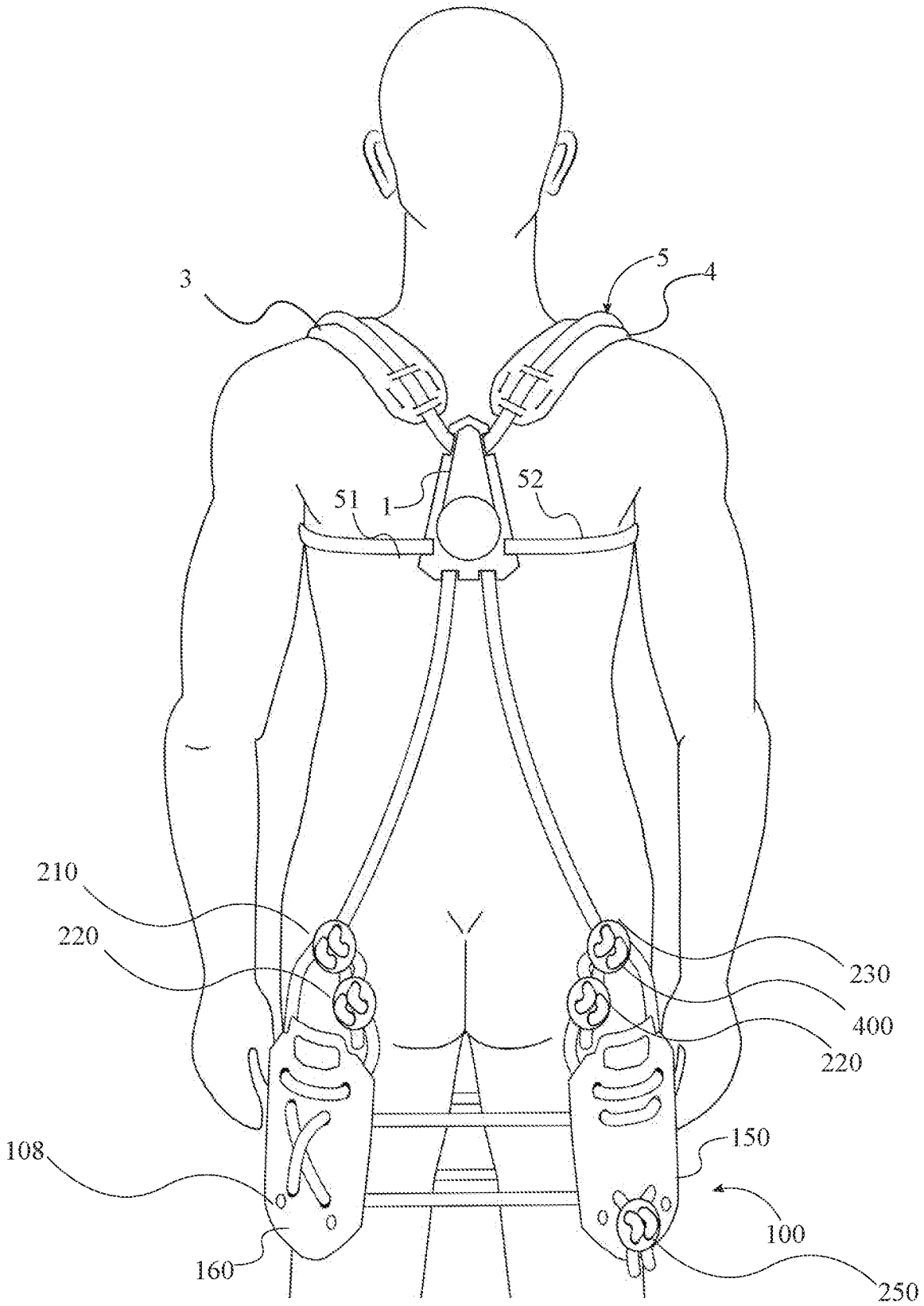
FIG. 13 is a rear view of the present invention with both the leg pads and shoulder pads in an operative configuration worn by a user.
Figure 14:
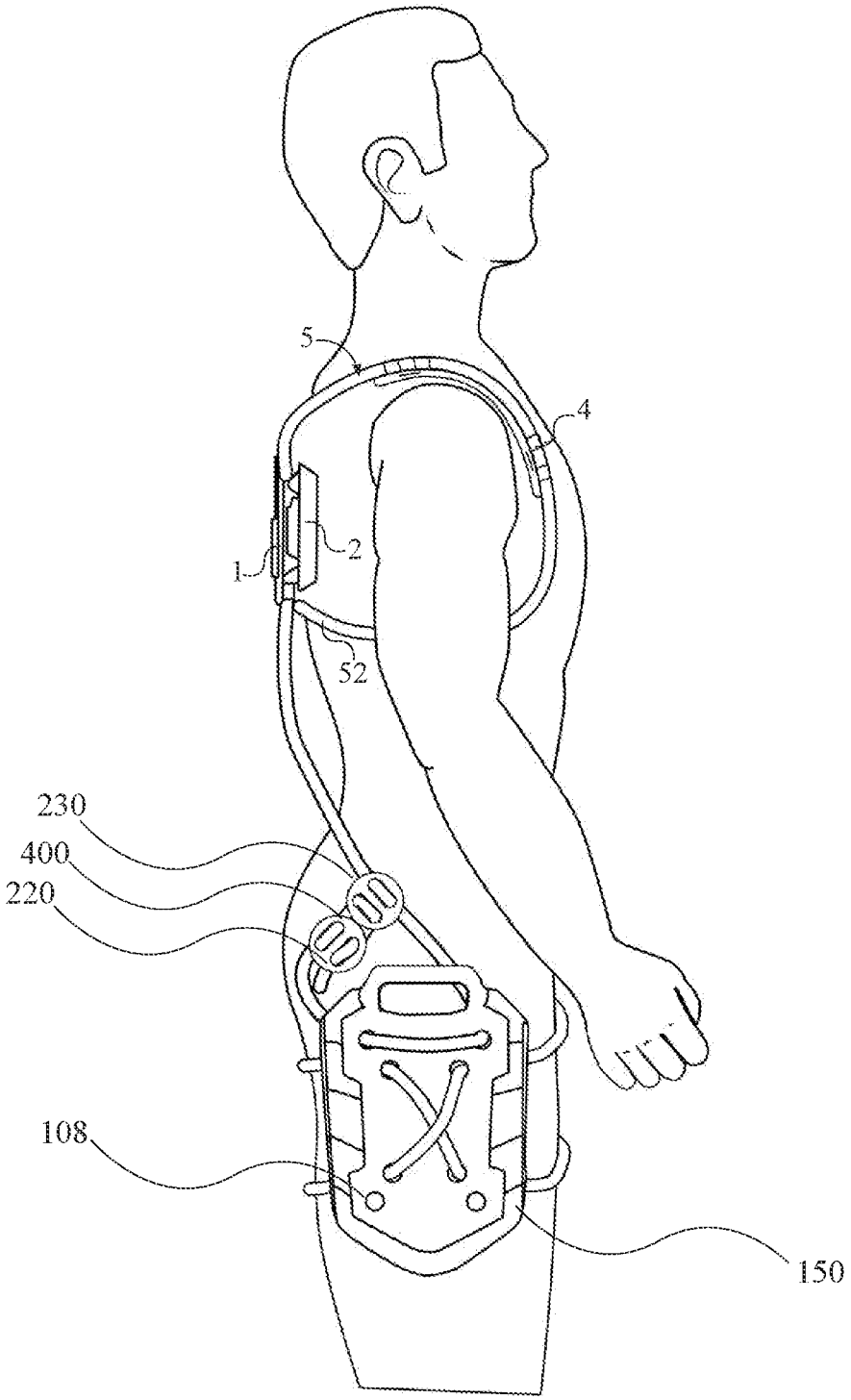
FIG. 14 is a right-side view of the present invention with both the leg pads and shoulder pads in an operative configuration worn by a user.
Figure 15:
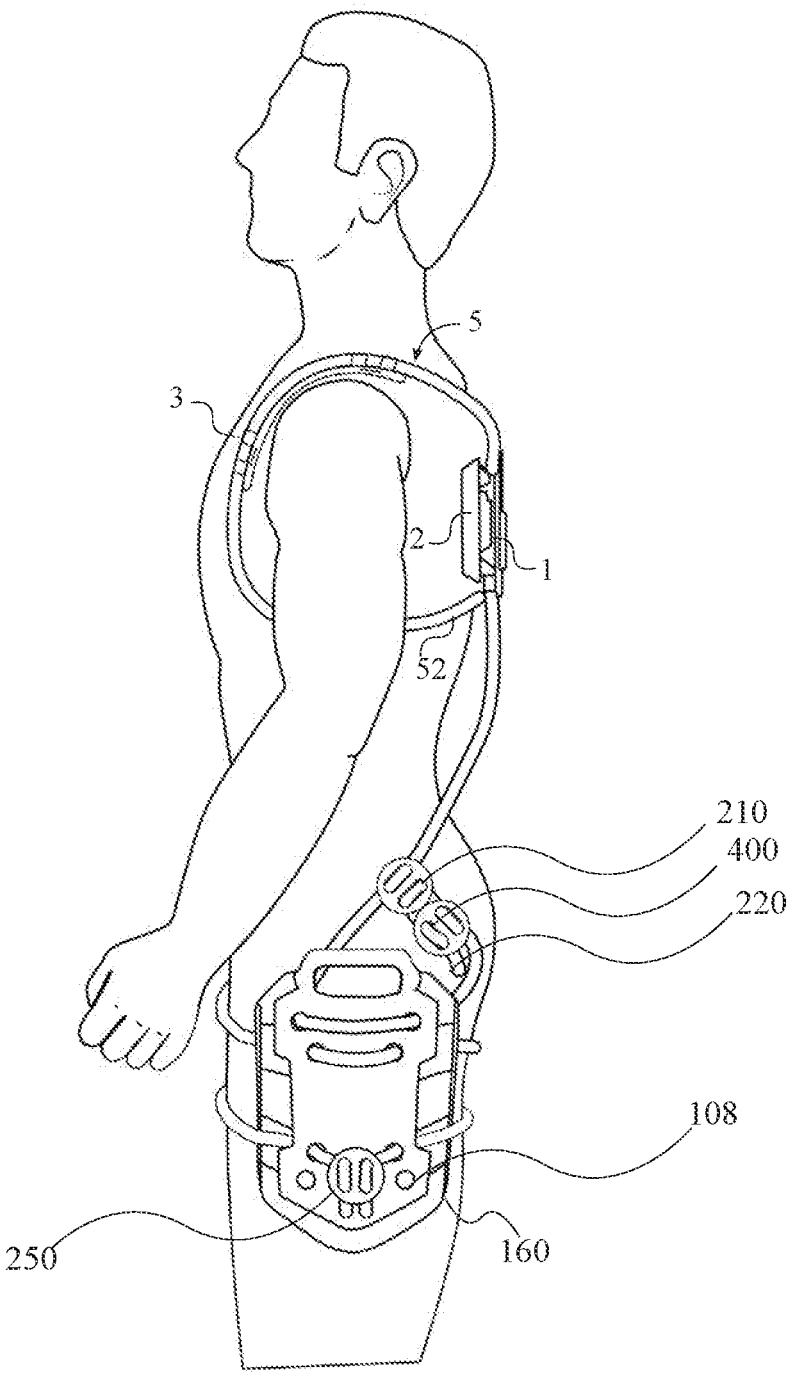
FIG. 15 is a left-side view of the present invention with both the leg pads and shoulder pads in an operative configuration worn by a user.
Figure 16:
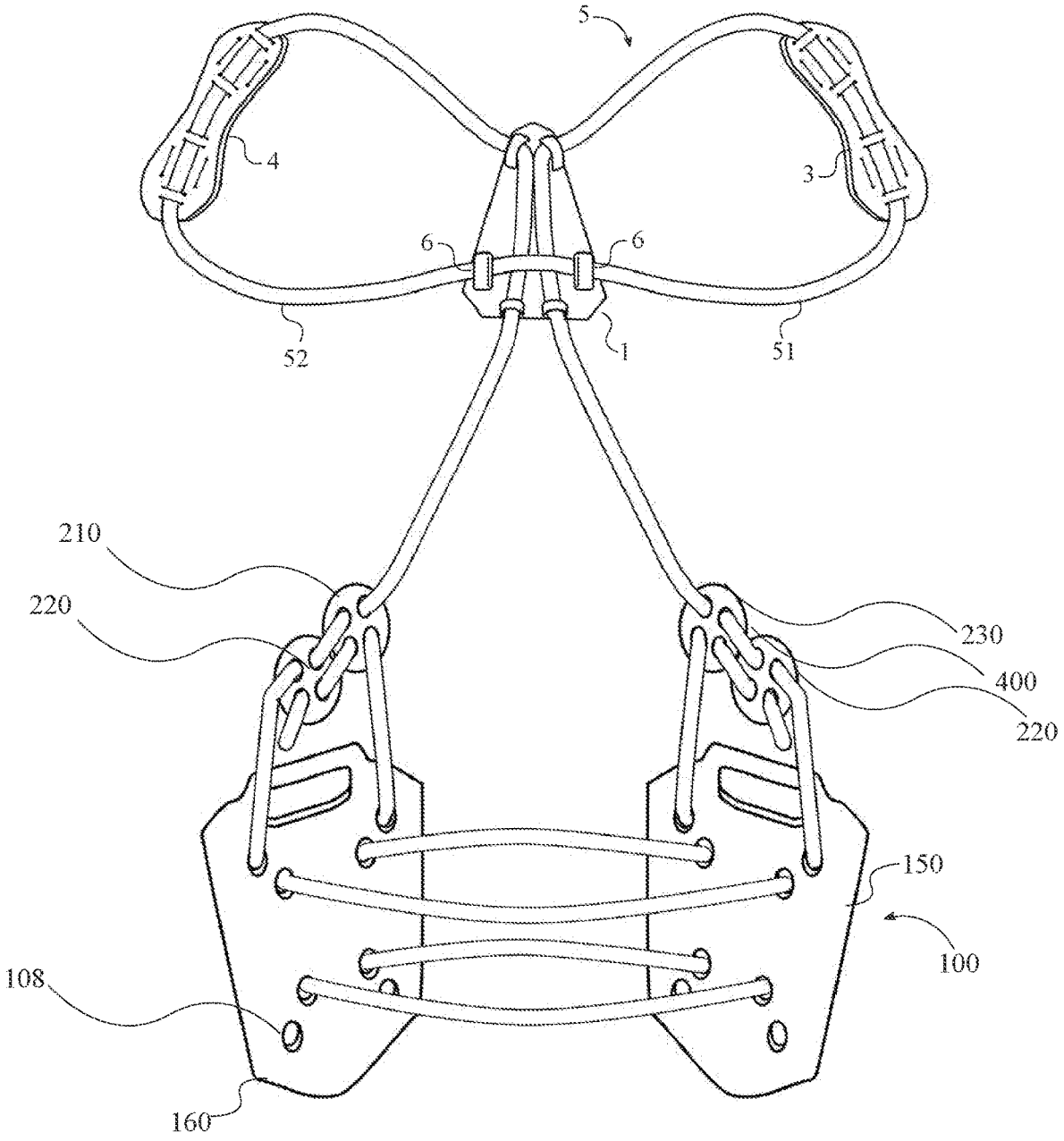
FIG. 16 is a front view of the present invention with both the leg pads and shoulder pads in an operative configuration.

Referring to FIG. 1 and FIG. 11, the present invention is an elastic resistance support designed to align the vertebra of the spine, engage the abdominal muscles, and apply resistance to the body over time to build better strength and endurance. The preferred embodiment of the present invention comprises an anchor plate 1, a support cushion 2, a left shoulder pad 3, a right shoulder pad 4, an elastic cord 5, and a plurality of eyelets 6. In the preferred embodiment, the elastic cord 5 applies progressive resistance to the left and right shoulders of the user to align the user's spine and preserve good posture. Further, the elastic cord 5 stretches to vary the level of resistance being generated. In the preferred implementation, the anchor plate 1 allows a user to selectively stiffen the elastic cord 5 and apply resistance to the left or right shoulder. This causes muscles to contract which stimulates bone and muscle growth. In the preferred implementation, the anchor plate 1 presses against the user's torso. As such, the support cushion 2 is provided to soften the force of the anchor plate 1 pressing against the user's torso. The plurality of eyelets 6 allows the elastic cord 5 to traverse through the anchor plate 1. The left shoulder pad 3 and the right shoulder pad 4 are positioned between the elastic cord 5 and the user's shoulders to provide cushioning for the user. As can be seen in FIG. 7-12, the left direction and the right direction as herein referred to is relative to the user's body. Thus, left corresponds to left in user's perspective and right corresponds to right in the user's perspective.

Figure 2:
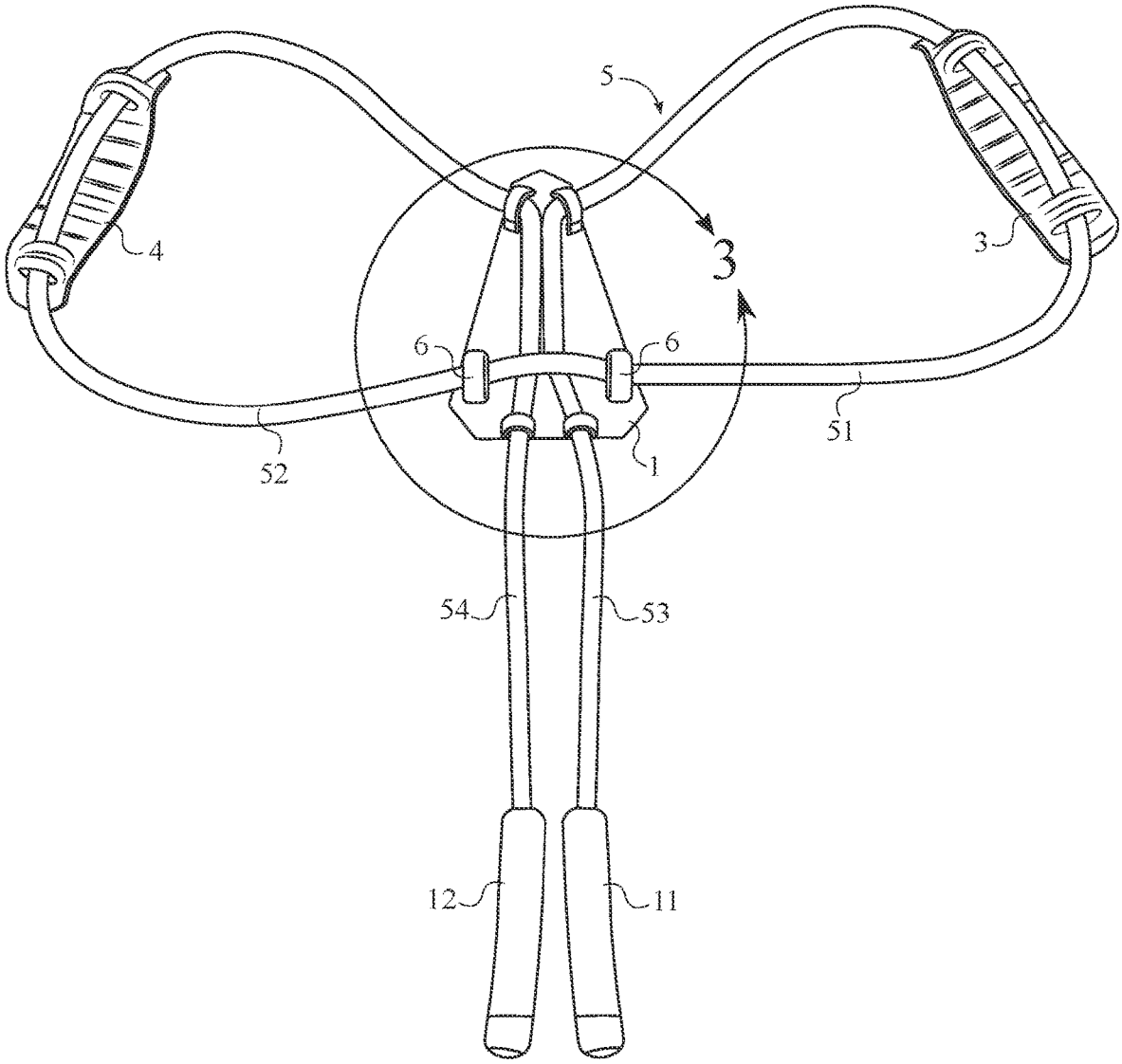
FIG. 2 is a front view of the present invention with the support cushion detached from the anchor plate.
Figure 4:
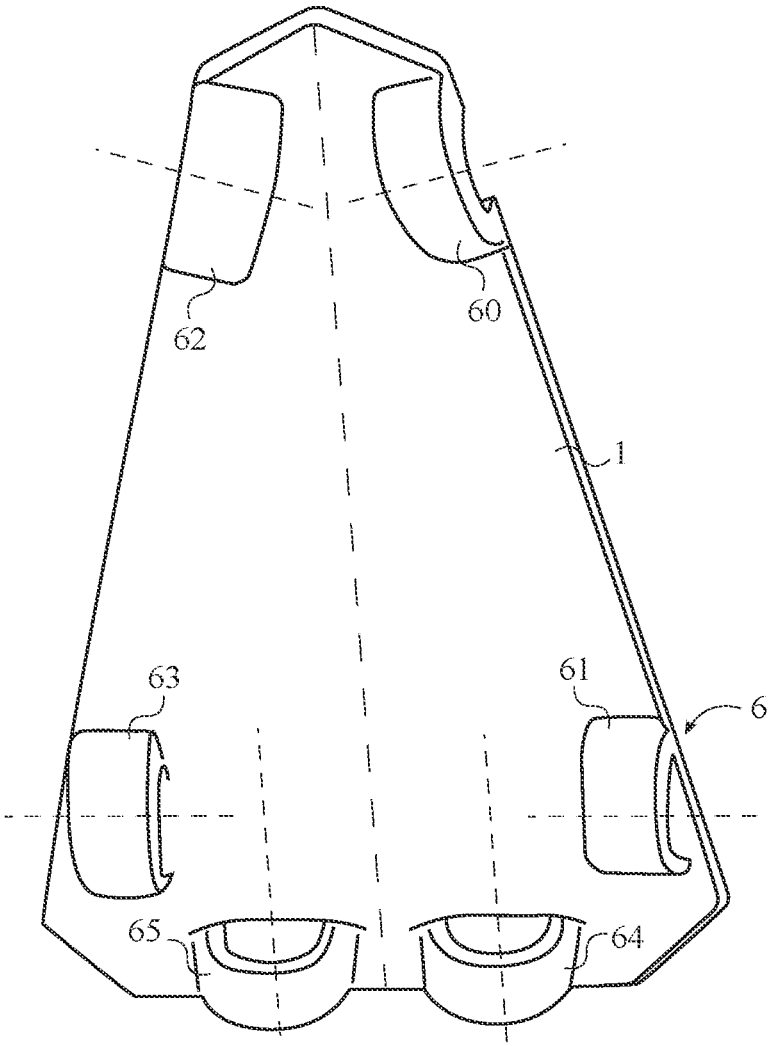
FIG. 4 is a perspective view of the anchor plate showing the parallel orientation of the opening of the plurality of eyelets.

Referring to FIG. 2 and FIG. 4, in the preferred embodiment of the present invention, the plurality of eyelets 6 configures the elastic cord 5 to brace the shoulders and/or the legs. Preferably, the plurality of eyelets 6 is mounted between the anchor plate 1 and the support cushion 2. This positions the elastic cord 5 to accept the support cushion 2. An opening for each of the plurality of eyelets 6 is oriented parallel to the anchor plate 1. This prevents the elastic cord 5 from getting caught on any one of the plurality of eyelets 6 and enables the elastic cord 5 to move about the anchor plate 1 as intended. In the preferred embodiment, the plurality of eyelets 6 is configured to weave the elastic cord 5 into a left loop portion 51, a right loop portion 52, a left cord end 53, and a right cord end 54. The left loop portion 51 braces the left shoulder of the user, whereas the right shoulder pad 4 braces the right shoulder of the user.

In the preferred embodiment, the left loop portion 51 and the right loop portion 52 are designed to expand and contract from the anchor plate 1. As such, the left loop portion 51 is positioned adjacent to the anchor plate 1. Similarly, the right loop portion 52 is positioned adjacent to the anchor plate 1, opposite the left loop portion 51. The left cord end 53 and the right cord end 54 are positioned adjacent to each other. Further, the left cord end 53 and the right cord end 54 are positioned in between the left loop portion 51 and the right loop portion 52. The left shoulder pad 3 and the right shoulder pad 4 are provided to prevent the elastic cord 5 from rubbing against the user's shoulders during extension and contraction. As such, the left shoulder pad 3 is slidably mounted along the left loop portion 51, and the right shoulder pad 4 is slidably mounted along the right loop portion 52. As a result, the left shoulder pad 3 and the right shoulder pad 4 remain static as the elastic cord 5 slides while pressed against the user's shoulders.

Figure 3A:
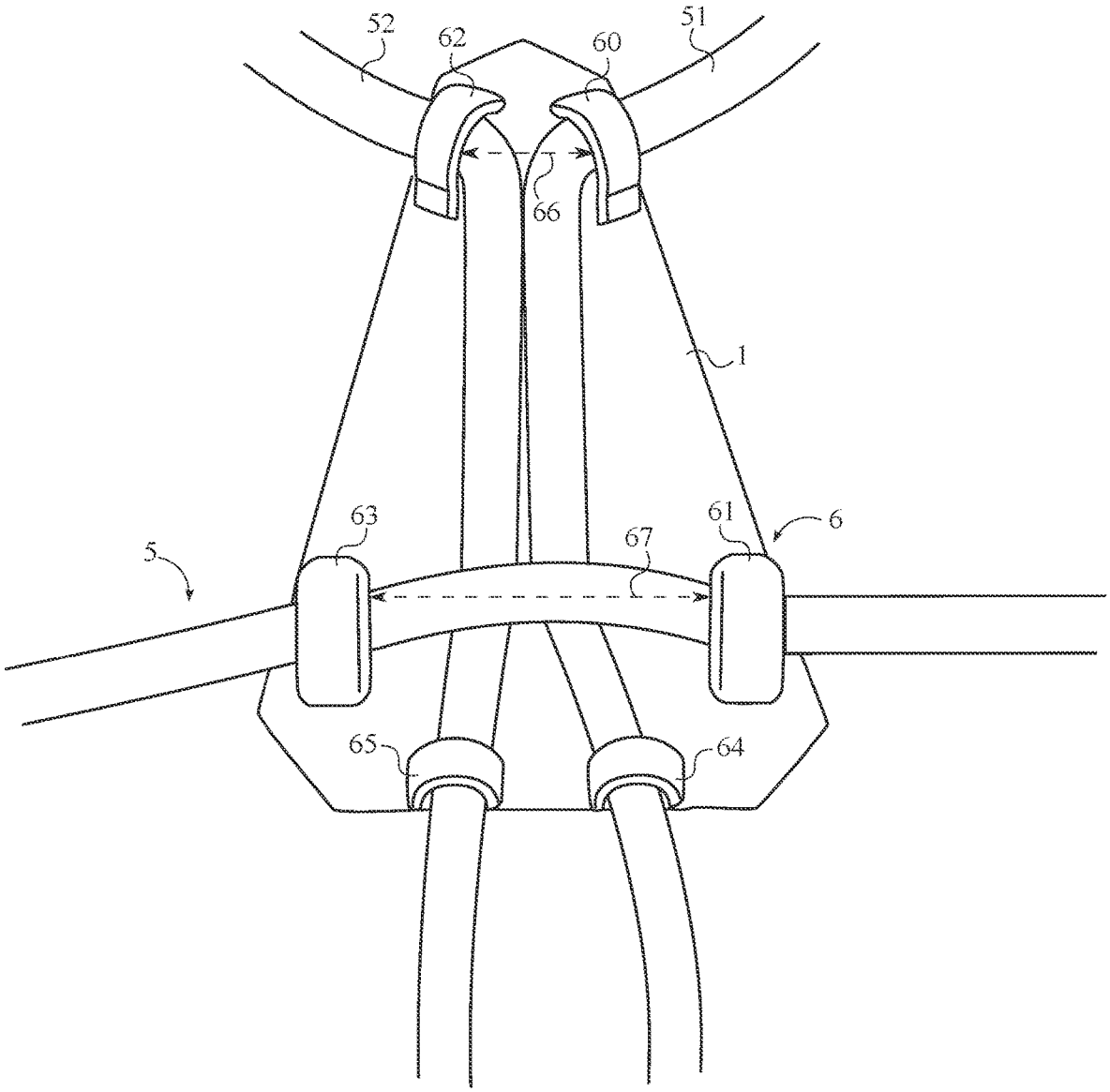
FIG. 3A is a detail view of circle 3 in FIG. 2 illustrating the elastic cord traversing through the plurality of eyelets.

Referring to FIG. 3A, the plurality of eyelets 6 is configured to direct the elastic cord 5 to the desired direction and to ensure the elastic cord 5 freely slides along the anchor plate 1, as required to resize the left loop portion 51 and the right loop portion 52. As such, the plurality of eyelets 6 comprises a first left eyelet 60, a second left eyelet 61, a first right eyelet 62, a second right eyelet 63, a first bottom eyelet 64, and a second bottom eyelet 65. The preferred eyelet may be an arc integrated and extending parallel to the anchor plate 1, though any contoured channel may be utilized in alternate embodiments. The first left eyelet 60 and the first right eyelet 62 are positioned offset from each other across the anchor plate 1. Likewise, the second left eyelet 61 and the second right eyelet 63 are positioned offset from each other across the anchor plate 1. As a result, the first left eyelet 60 and the second left eyelet 61 are facing towards a left lateral edge of the anchor plate 1. In contrast, the first right eyelet 62 and the second right eyelet 63 are facing towards a right lateral edge of the anchor plate 1. Further, the first left eyelet 60 and the first right eyelet 62 are positioned offset from the second left eyelet 61 and the second right eyelet 63 across the anchor plate 1. In the preferred embodiment, the first left eyelet 60 and the first right eyelet 62 are positioned near the vertex of the triangular-shaped anchor plate 1. The second left eyelet 61 and the second right eyelet 63 are positioned near the base of the triangular-shaped anchor plate 1. In other words, the first left eyelet 60 and the first right eyelet 62 are preferably positioned on the upper portion of the anchor plate 1 whereas the second left eyelet 61 and the second right eyelet 63 are positioned on the lower portion, opposite the upper portion. Finally, the first bottom eyelet 64 is positioned adjacent to the second left eyelet 61. The second bottom eyelet 65 is positioned adjacent to the second right eyelet 63. As a result, the first bottom eyelet 64 and the second bottom eyelet 65 are facing towards the bottom edge of the anchor plate 1.

Referring back to FIG. 3A, the preferred anchor plate 1 is a triangular sheet of plastic oriented so that the base is pointing downwards in relation to the body of the user. As such, the first left eyelet 60 and the first right eyelet 62 are positioned offset from each other across the anchor plate 1 by a first distance 66. Likewise, the second left eyelet 61 and the second right eyelet 63 is positioned offset from each other across the anchor plate 1 by a second distance 67. Further, the first distance 66 is smaller than the second distance 67. This gives the anchor plate 1 a triangular shape as required to brace the elastic cord in the desired position. This gives the anchor plate 1 a triangular shape that tapers to a vertex at the upper portion. Consequently, a base is positioned at the lower portion of the anchor plate 1, opposite the base. Preferably, the first distance 66 is positioned adjacent to the vertex and the second distance 67 is positioned adjacent to the base.

Figure 3B:
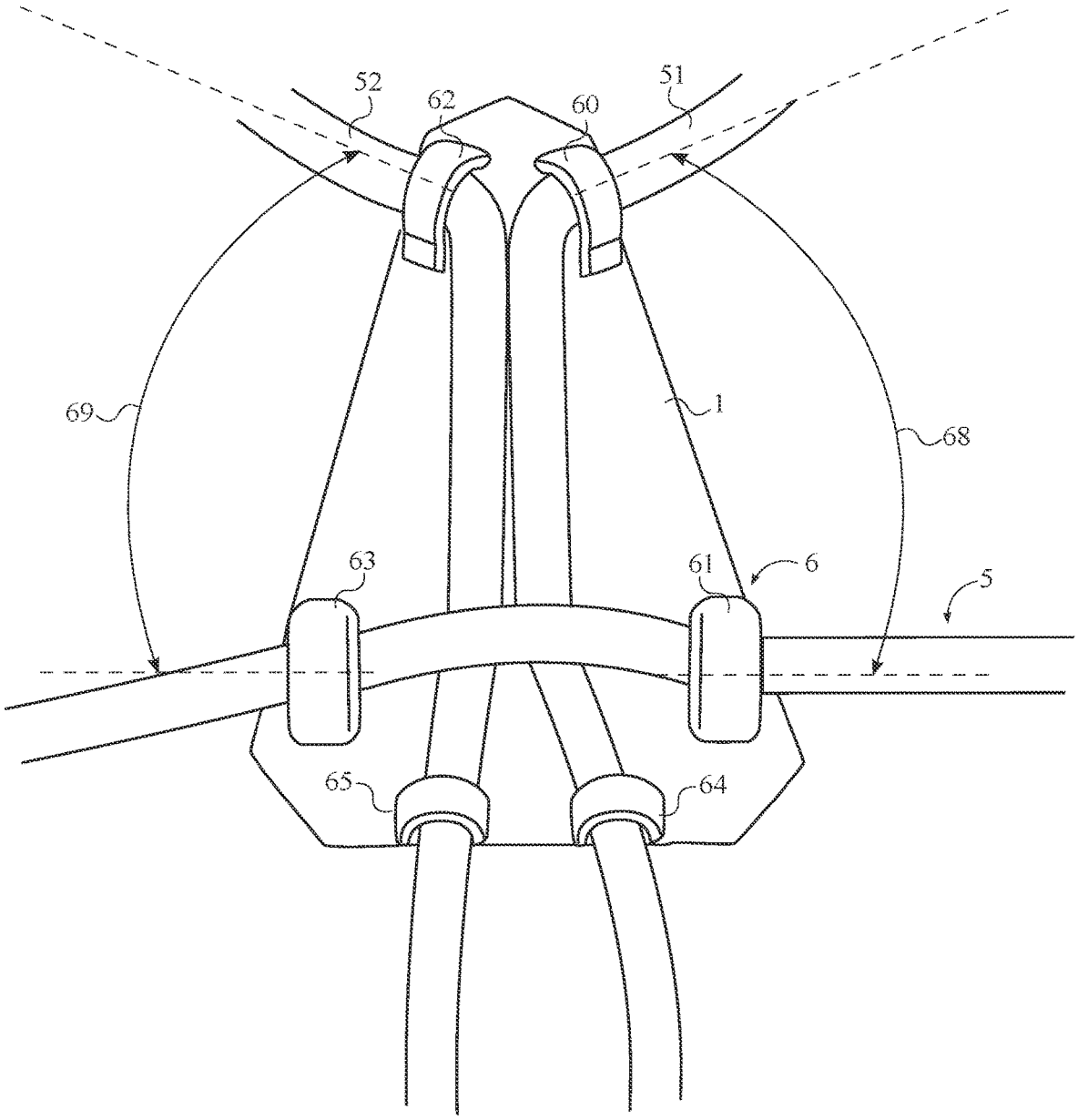
FIG. 3B is a detail view of circle 3 in FIG. 2 illustrating the left acute angle of the first left eyelet and the right acute angle of the first right eyelet.

Referring to FIG. 4, the plurality of eyelets 6 is arranged to prevent the elastic cord 5 from getting caught on any single eyelet. Accordingly, the section of elastic cord 5 moving within a single eyelet is positioned parallel to the opening of the eyelet. Referring now to FIG. 3B, in the preferred implementation of the present invention, the anchor plate 1 is positioned below the shoulders of the user, and the ends of the left loop portion 51 and the right loop portion 52 are oriented at an angle to the anchor plate 1. Thus, the opening of the first left eyelet 60 and the opening of the second left eyelet 61 are oriented at a left acute angle 68 with each other. Similarly, the opening of the first right eyelet 62 and the opening of the second right eyelet 63 is oriented at a right acute angle 69 with each other. For the left acute angle 68, the horizontal is defined as the direction that the opening traverses through the second left eyelet 61. Similarly, for the right acute angle 69, the horizontal is defined as the direction that the opening traverses through the second right eyelet 63. Consequently, the left acute angle 68 is positive in the clockwise direction. However, the right acute angle 69 is positive in the counter-clockwise direction. Further, the left acute angle 68 and the right acute angle 69 are equal to each other. Although, the exact value of both the left acute angle 68 and the right acute angle 69 may change based on the positioning of the anchor plate 1 in relation to the user's shoulders the left acute angle 68 must be equal to the right acute angle 69 to ensure that the left loop portion 51 and the right loop portion 52 remain engaged to the shoulders. Finally, the opening of the second left eyelet 61 and the second right eyelet 63 are positioned collinear to each other. This allows the elastic cord 5 to freely slide within the first left eyelet 60 and the first right eyelet 62.

Figure 3C:
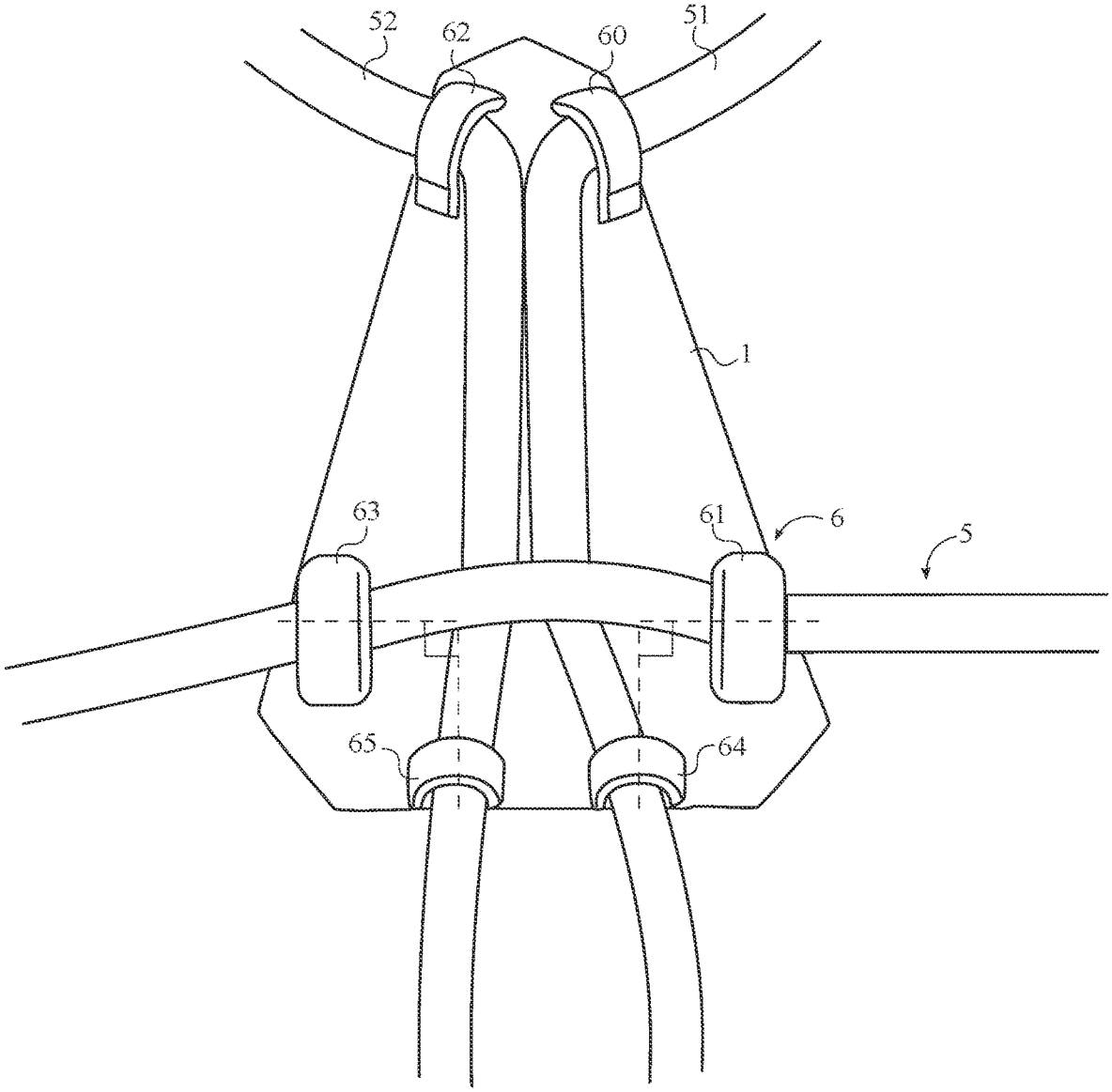
FIG. 3C is a detail view of circle 3 in FIG. 2 illustrating the perpendicular orientation of the second left eyelet and the second right eyelet with the first bottom eyelet and the second bottom eyelet, respectively.

Referring to FIG. 3C, the opening of the second left eyelet 61 and the opening of the first bottom eyelet 64 are oriented perpendicular to each other. Likewise, the opening of the second right eyelet 63 and the opening of the second bottom eyelet 65 are oriented perpendicular to each other. This causes the left loop portion 51 and the right loop portion 52 to crisscross at the center of the anchor plate 1, thereby creating continuous loops that securely brace the user's shoulders. Further, the opening of the first bottom eyelet 64 and the opening of the second bottom eyelet 65 are positioned parallel to each other. This allows the user to apply equal force to the left cord end 53 and the right cord end 54.

Referring to FIG. 2-3C, in the preferred embodiment of the present invention, the elastic cord 5 serially weaves through the first bottom eyelet 64, through the first left eyelet 60, through the second left eyelet 61, through the second right eyelet 63, through the first right eyelet 62, and through the second bottom eyelet 65. Preferably, the left loop portion 51 is shaped from the section of the elastic cord 5 that traverses through the first bottom eyelet 64, through the second left eyelet 61, and through the second left eyelet 61. Similarly, the right loop portion 52 is shaped from the section of the elastic cord 5 that traverses through the second bottom eyelet 65, through the first right eyelet 62, and through the second right eyelet 63. The left loop portion 51 and the right loop portion 52 connect at the center of the anchor plate 1. Accordingly, the left cord end 53 is the section of the elastic cord 5 situated at the first bottom eyelet 64, opposite the left loop portion 51. Similarly, the right cord end 54 is the section of the elastic cord 5 situated at the second bottom eyelet 65, opposite the right loop portion 52. In the preferred embodiment, the left loop portion 51 braces the left shoulder, whereas the right loop portion 52 braces the right shoulder. Preferably, the left cord end 53 and the right cord end 54 connect to handles, which when pulled, adjust the size of the left loop portion 51 and the right loop portion 52. Alternately, the left cord end 53 may be tied to the left leg, and the right cord end 54 may be tied to the right leg. Thus, the size of the left loop portion 51 and the right loop portion 52 may be linked to the walking motion.

Figure 5:
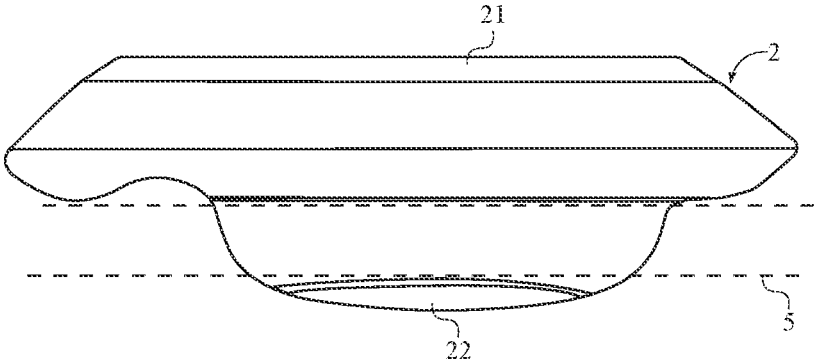
FIG. 5 is a side view of the support cushion with the elastic cord illustrated in broken lines.
Figure 6:
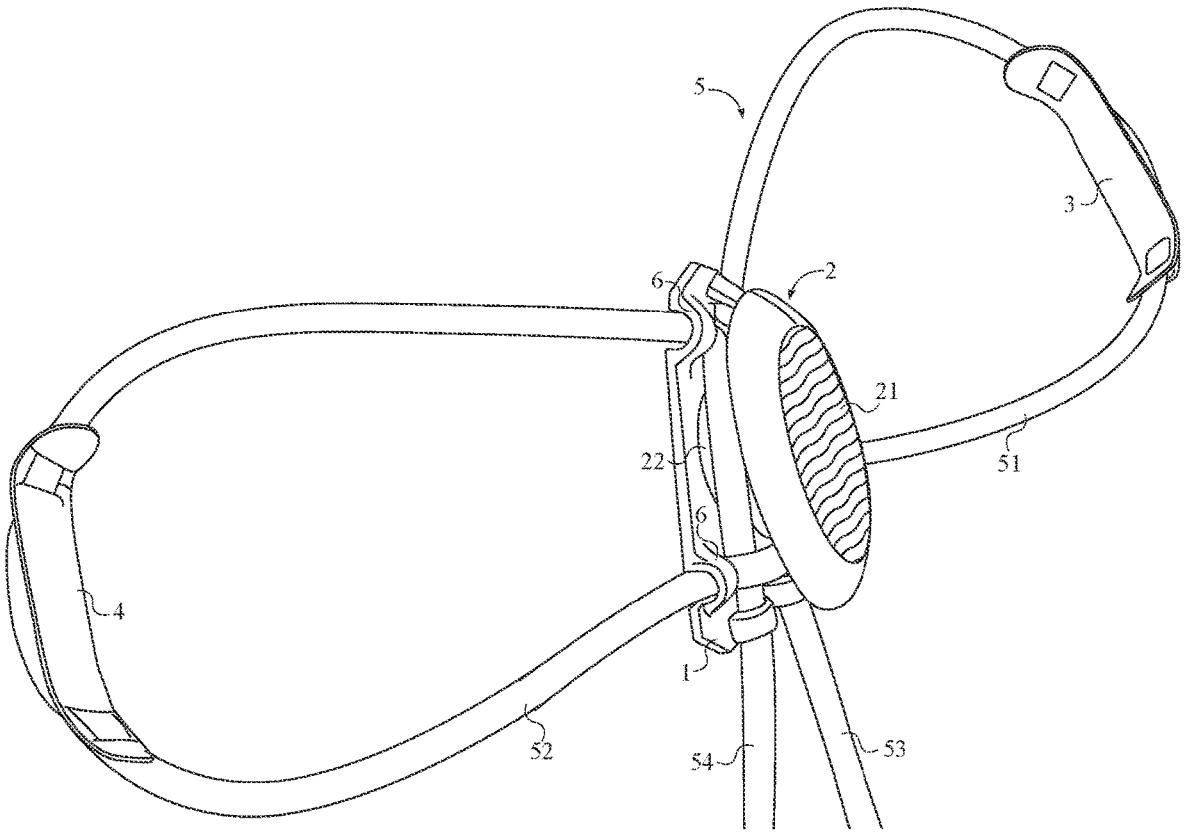
FIG. 6 is a front perspective view of the present invention showing the support cushion being fastened to the anchor plate by the elastic cord.

Referring to FIG. 5 and FIG. 6, the support cushion 2 protects the torso from the of the anchor plate 1 which presses against the torso. As such, the support cushion 2 comprises a torso-bracing portion 21 and at least one cleat 22. The torso-bracing portion 21 is a pliable plastic pad that deforms when pressed against the torso. The at least one cleat 22 is a kind of a wedge that protrudes out of the torso-bracing portion 21. Preferably, the at least one cleat 22 is centrally connected onto the torso-bracing portion 21.

This conceals the anchor plate 1 behind support cushion 2, the thereby preventing the anchor plate 1 from contacting the torso. The at least one cleat 22 is also positioned amongst the plurality of eyelets 6. This allows the elastic cord 5 to weave through the plurality of eyelets 6 and about the at least one cleat 22. More specifically, the left loop portion 51 braces the left side of the at least one cleat 22, whereas the right loop portion 52 braces the right side of the at least one cleat 22. The wedge slides in between the elastic cord 5 and the anchor plate 1, thereby fastening the support cushion 2 to the anchor plate 1. As a result, the support cushion 2 is tethered to the anchor plate 1 by the elastic cord 5.

Figure 7:
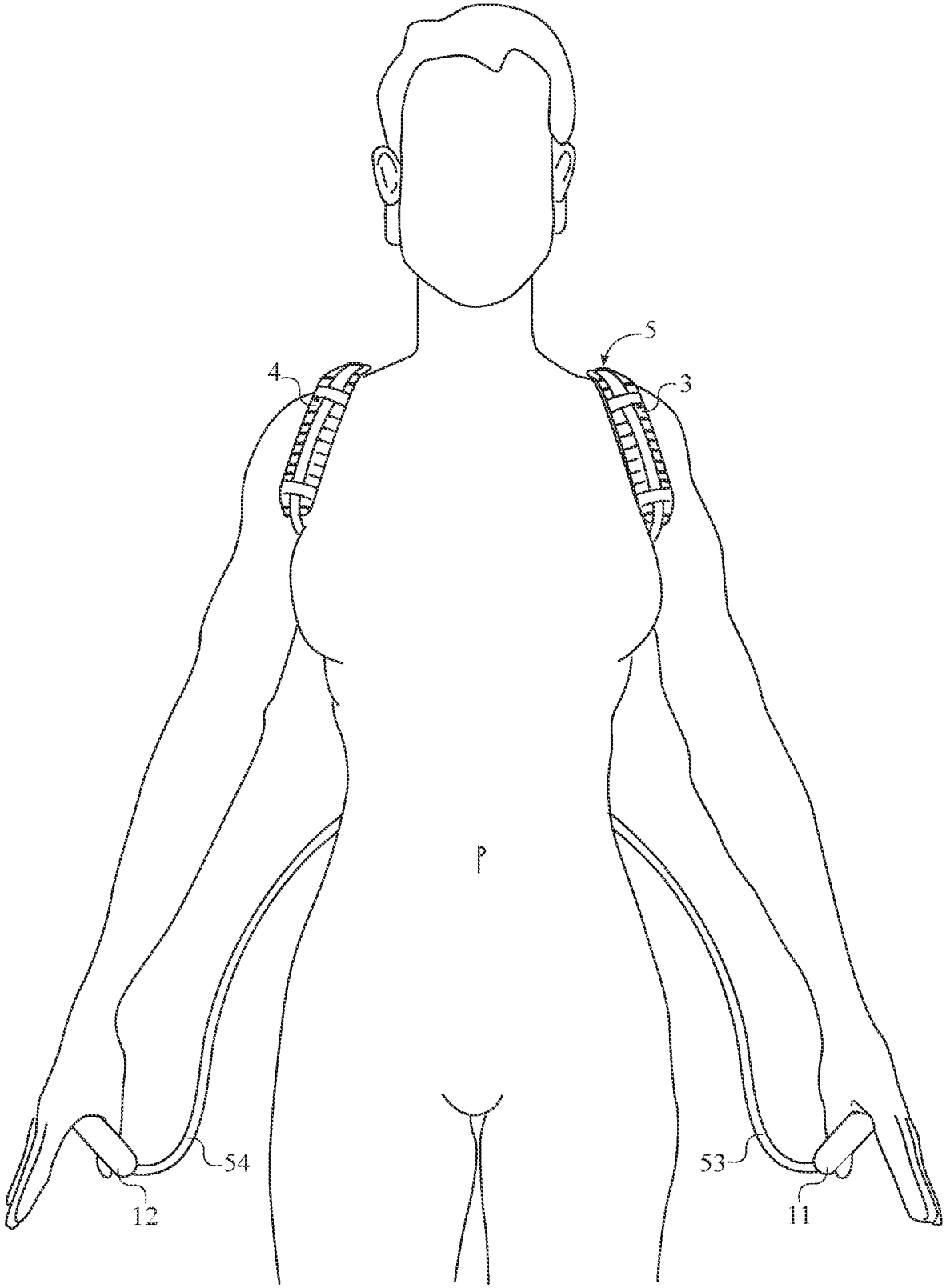
FIG. 7 is the front view of the present invention worn by a female user.
Figure 8:
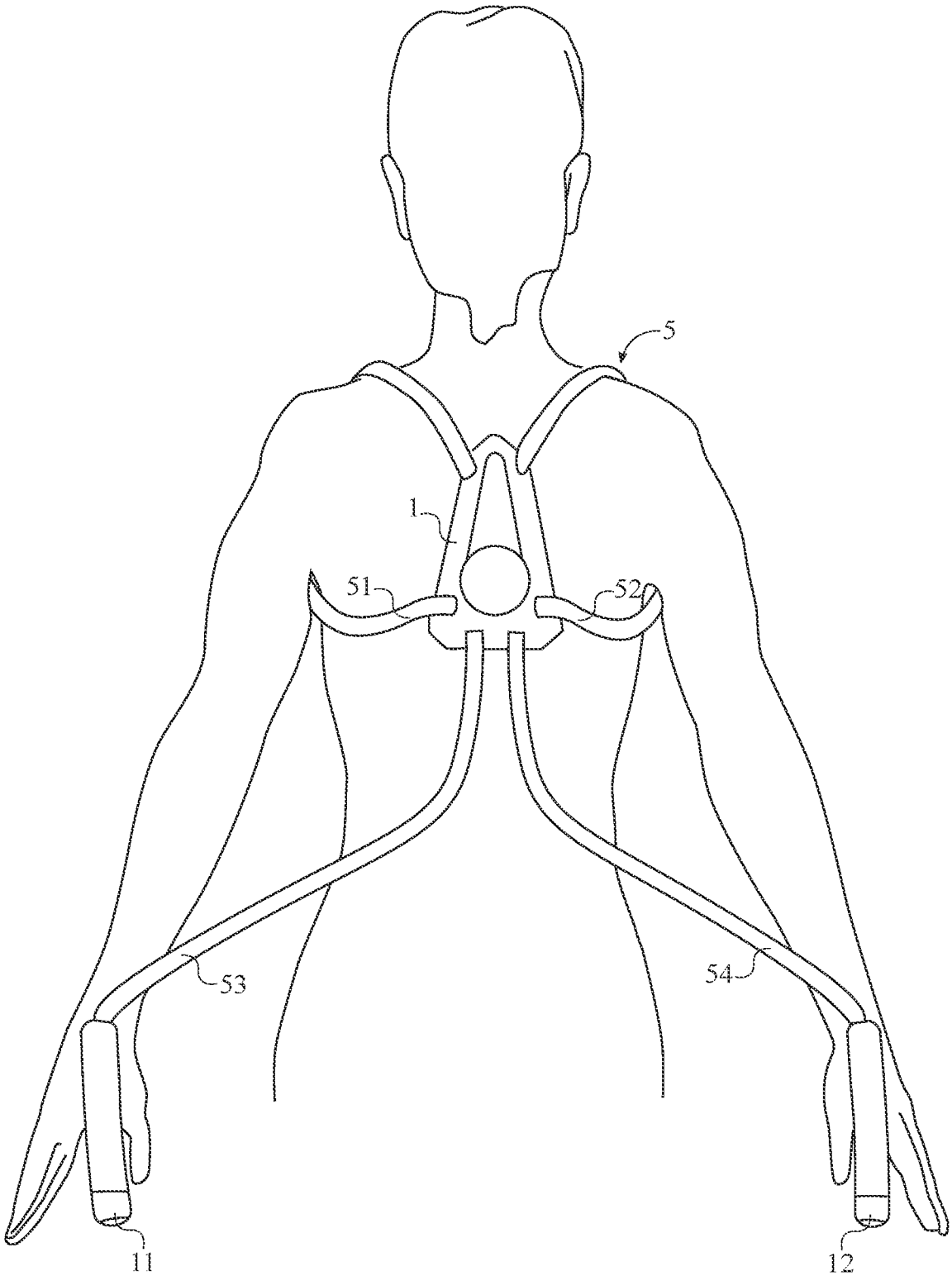
FIG. 8 is a rear view of the present invention worn by a female user.

Referring to FIG. 7 and FIG. 8, in the preferred operative configuration, the left cord end 53 and the right cord end 54 connect to handles which can be pulled to contract the left loop portion 51 and the right loop portion 52, respectively. As such, a first handle 11 is provided to enable the user to securely grip onto the left cord end 53. More specifically, the first handle 11 is terminally connected to the elastic cord 5 at the left cord end 53. Likewise, a second handle 12 is provided to help the user grip on the right cord end 54. More specifically, the second handle 12 is terminally connected to the elastic cord 5 at the right cord end 54. In the preferred implementation, the user must pull the first handle 11 and the second handle 12 at the same time to apply resistance on the shoulders. Pulling the first handle 11 and the second handle 12 causes the left loop portion 51 and the right loop portion 52 to contract, thereby pulling the shoulders towards the spine, and improving the posture of the user. Once the user lets go of the first handle 11 and the second handle 12, the left loop portion 51 and the right loop portion 52 expand to allow the left and right shoulder to move back to a forward position.

Figure 9:
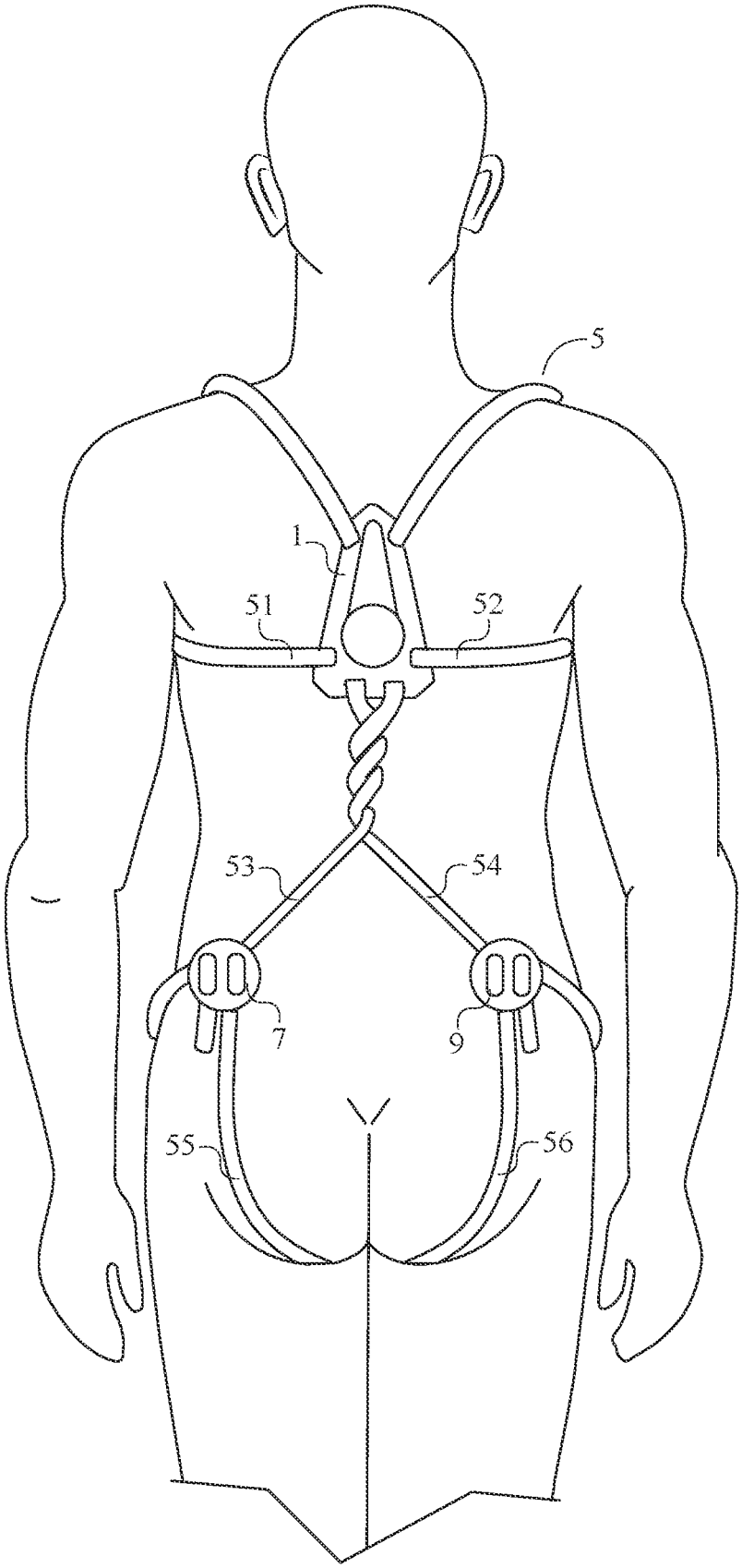
FIG. 9 is a rear view of the present invention, in an alternate operative configuration, worn by a male user.

Referring to FIG. 9 and FIG. 10, in an alternate operative configuration, a first button 7 is used to form the left cord end 53 into a left bottom loop 55. More specifically, the second button 9 is configured to weave the left cord end 53 into a left bottom loop 55. The left bottom loop 55 braces the user's left leg, thereby anchoring the left cord end 53 to the left leg. Further, a lower left pad 8 provides cushions the left leg from the left bottom loop 55. Preferably, the lower left pad 8 is slidably mounted along the left bottom loop 55, whereby the lower left pad 8 is positioned between the left bottom loop 55 and the left leg.

Similarly, a second button 9 is used to form the right cord end 54 into a right bottom loop 56. More specifically, the second button 9 is configured to weave the right cord end 54 into a right bottom loop 56. The right bottom loop 56 is designed to brace the user's right leg. To prevent the right bottom loop 56 from rubbing against the right leg, a lower right pad 10 is provided. The lower right pad 10 is slidably mounted along the right bottom loop 56. This positions the lower right pad 10 between the right leg and the right bottom loop 56.

By engaging the left bottom loop 55 and the right bottom loop 56 to the left leg and the right leg respectively, the elastic cord 5 is held under constant tension. Thus, a correcting resistance is constantly applied on the shoulders. Further, the elastic nature of elastic cord 5 allows for the application of progressive stimulus to the muscles, thereby gradually building muscular strength.

Referring to FIG. 11, in yet another operative configuration, the left bottom loop 55 and the right bottom loop 56 can be used as handles. This allows the user to selectively stiffen the elastic cord 5 and control the resistance being applied to the muscles. Further, the lower left pad 8 may be used to cushion the user's left hand against the left bottom loop 55, whereas the lower right pad 10 may be used to cushion the user's right hand.

In another embodiment, the elastic resistance support may comprise at least one lower pad 100. The at least one lower pad 100 further comprises a first section 102, a second section 104, and a third section 106. The elastic resistance support may further comprise at least one button 200 and a locking fixture 400.

The at least one lower pad 100 is a fundamental member of the elastic resistance support. The at least one lower pad 100 takes an ergonomic shape that provides a comfortable fit for the user's thighs. Moreover, the at least one lower pad 100 serves as the main mounting platform for the elastic cord 5 and the at least one button 200. More specifically, the at least one lower pad 100 serves as a guard that rests on the thighs of the user. Furthermore, the at least one lower pad 100 is curved to take the shape of the thigh of a user, ideally being concave in shape along the back side of the lower pad. In some embodiments, the at least one pad may comprise a plurality of pads. In the ideal embodiment, the elastic resistance support comprises a left lower pad and a right lower pad. Each of the plurality of pads resembles each other. Hereinafter, any reference to "the lower pad" or "the at least one lower pad 100" should be construed to refer to each of the plurality of lower pads if more than one lower pad is used in a particular embodiment, such that each of the plurality of lower pads is identical.

Referring now to FIGS. 18 and 24-27, in the ideal embodiment, the first section 102 comprises a first arc 112, a second arc 114, a third arc 116, and a bevel 118. The first section 102 is the outermost layer of the at least one lower pad 100. In the ideal embodiment of the present invention, the first section 102 is an extrusion that takes the form of an alphabetical capital letter "I". The first section 102 is a semi-rigid material which acts as a reinforcement for the lower pad, providing a platform for a plurality of pad apertures 108. The first arc 112 further comprises a first indent 113. The second arc 114 further comprises an upper aperture 115. The third arc 116 further comprises a second indent 117.

The first arc 112 of the first section 102 is positioned along the left side of the first section 102. The first indent 113 of the first section 102 is ideally vertically halfway along the first section 102.

The second arc 114 is ideally positioned on the upper side of the lower pad, connecting the upper sides of the first arc 112 and the third arc 116. The upper aperture 115 is ideally positioned halfway horizontally along the second arc 114. The upper aperture 115 provides an empty space between the center of the first section 102 and the top of the second arc 114, such that the upper aperture 115 provides a place for the user to grip the at least one lower pad 100 or thread an object through the upper aperture 115.

The third arc 116 is ideally positioned directly opposite the first arc 112, along the right side of the lower pad. The second indent 117 is ideally positioned vertically halfway along the third section 106.

The bevel 118 is ideally positioned towards the bottom side of the lower pad, connecting the bottom sides of the first arc 112 and the third arc 116. The bevel 118 is a curved smooth corner, which serves as an ergonomic feature so that no sharp corners exist.

This ideal embodiment of the at least one lower pad 100 ensure that the at least one lower pad 100 need not encircle the thigh of the user during use. Ideally, the at least one lower pad 100 is positioned to and conforms to the shape of the outside of the user's thigh, leading to a more comfortable and ergonomic use that improves the quality of exercise compared to designs that restrict the interior of the thigh of the user.

It should be noted that any shape, size, or positioning for the geometry of the first section 102, second section 104, and third section 106 of the at least one lower pad is contemplated by the present invention.

The second section 104 comprises a plurality of grooves 122 and a plurality of cells 124. In the ideal embodiment, the plurality of grooves 122 are positioned longitudinally along the second section 104, such that the space between each groove in the plurality of grooves 122 forms a raised cell. The plurality of grooves 122 acts as a ventilation and air flow guide for the user. The plurality of cells 124 allow for a proper fit of the lower pad and makes the lower pad more ergonomic for the user.

The third section 106 of the lower pad further comprises structural cross webbing 132. The structural cross webbing 132 reinforces the strength of the lower pad to improve durability, and further can provide ventilation and act as an airflow guide to the user by raising the lower pad off of the user's skin. In the ideal embodiment, the third section 106 is concave in shape to accommodate the shape of the user's thigh.

Figure 18:
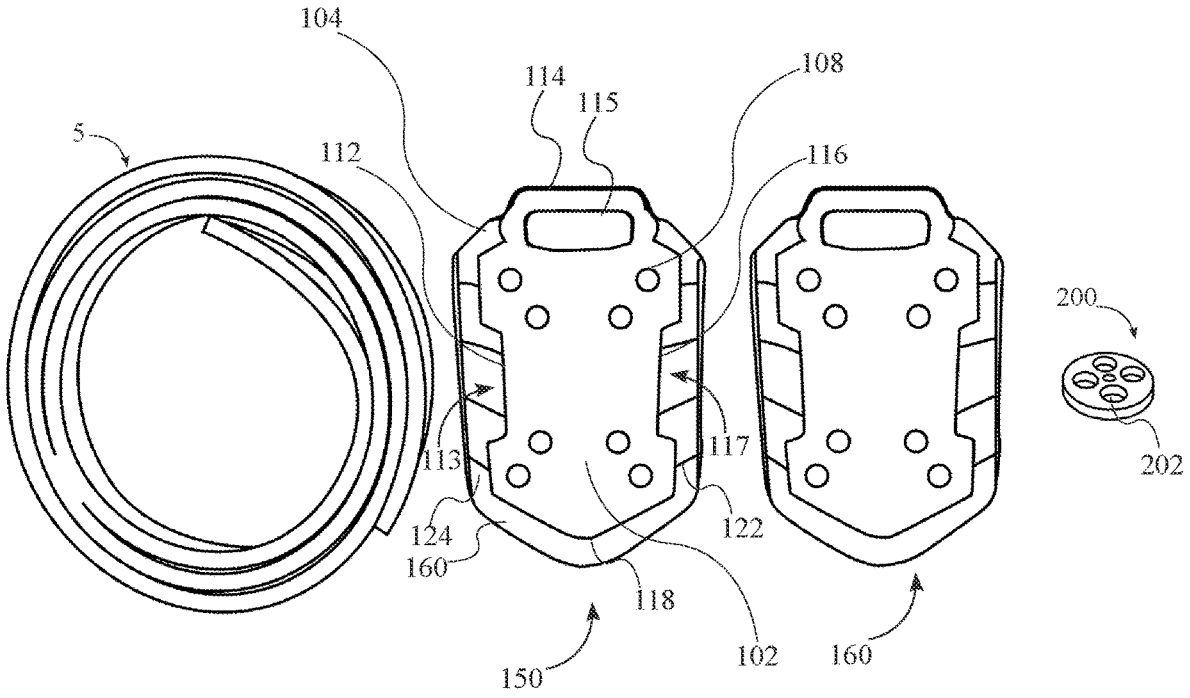
FIG. 18 is a front view of the componentry of the lower half of the present invention: the elastic cord, the lower right pad, the lower left pad, and a button.

The plurality of pad apertures 108 is a series of openings which traverse through the lower pad. In the preferred embodiment of the present invention, the plurality of pad apertures 108 resides on the center of the lower pad, forming a rectangle where the plurality of pad apertures 108 is placed at each corner of the rectangle. It is noted that the plurality of apertures may be arranged into any suitable shape or size, and is not restricted to a rectangular shape. In the ideal embodiment, the plurality of pad apertures 108 comprises eight total pad apertures. As seen in FIG. 18, two pad apertures are placed diagonally adjacent along each corner of the first section 102. This placement facilitates an ergonomic and efficient connection for the elastic cord 5, as seen in FIG. 24-27. In the ideal embodiment, the elastic cord 5 is configured to pass through the plurality of pad apertures 108 to connect the components of the elastic support harness.

As noted earlier, in the ideal embodiment of the present invention, the at least one lower pad 100 comprises a lower left pad 160 and a lower right pad 150. As seen in FIG. 24-27, the lower left pad 160 and the lower right pad 150 are designed to be slidably connected to each other using the elastic cord 5. The words "slidably connected" as used in this document should be construed to mean that the components can be freely adjusted along the elastic cord 5 by loosening or tightening the elastic cord 5, or by sliding the components themselves along the length of the elastic cord 5.

As seen in FIG. 24-27, the lower left pad 160 and lower right pad 150 can be slidably connected by threading or weaving the elastic cord 5 through the plurality of pad apertures 108, such that the elastic cord 5 attaches the left lower pad and the right lower pad while leaving a central space for the user. FIG. 20-23 shows an exemplary embodiment of the lower left pad 160 and lower right pad 150 being slidably connected in a position of use using the plurality of pad apertures 108 and a locking button 250.

In one embodiment, the at least one thigh pad 100 is designed for use with the system for the upper torso, as described above, and can connect to the anchor plate 1 to operatively connect the at least one thigh pad 100 to the upper portion of the system, such as the right shoulder pad 4 and left shoulder pad 3. In this embodiment, as seen in FIG. 12-17, the left lower pad 160 is designed to be slidably connected to the anchor plate 1, and the right lower pad 150 is designed to be slidably connected to the anchor plate 1. This may be done using the locking mechanism 400. In the ideal embodiment, the locking mechanism 400 comprises two buttons. The elastic cord 5 is designed to weave through the plurality of button apertures 202 to slidably attach the lower pads to the upper portion of the system.

Figure 17:
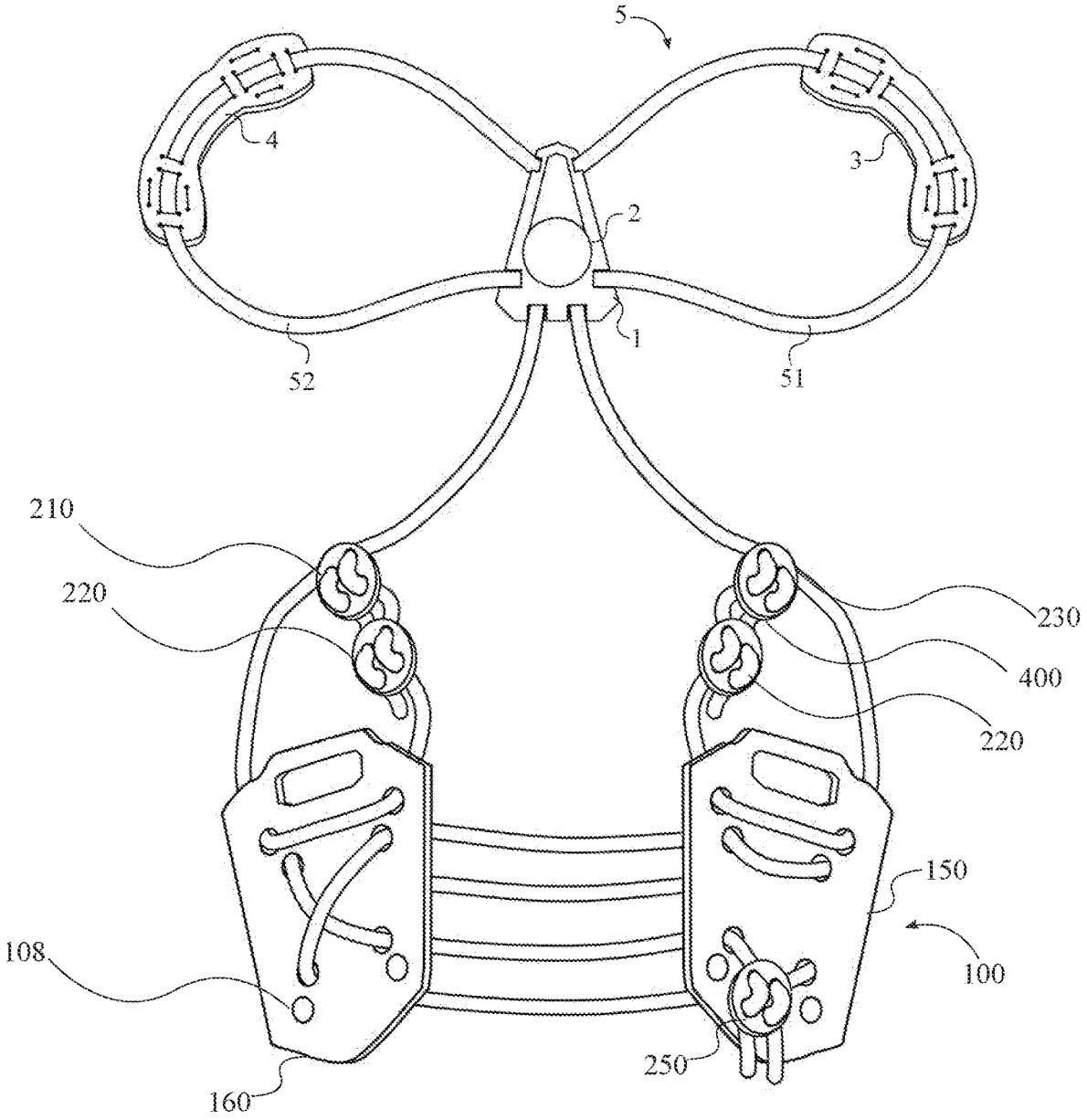
FIG. 17 is a back view of the present invention with both the leg pads and shoulder pads in an operative configuration.

In the ideal embodiment, each side of the support will comprise a locking fixture 400. For example, the left locking fixture 400 may comprise a first lower left button 210, a second lower left button 220, while the right locking fixture 400 may comprise a first lower right button 230, a second lower right button 240, and a locking button 250. As seen in FIG. 17, the first lower left button 210 and second lower left button 220 are configured to slidably hold the elastic cord 5 by threading the elastic cord 5 through the button apertures, such that the lower left pad 160 is slidably connected to the anchor plate 1. Similarly, the first lower right button 230 and second lower right button 240 are configured to slidably hold the elastic cord 5 by threading the elastic cord 5 through the button apertures, such that the lower right pad 150 is slidably connected to the anchor plate 1.

As shown in FIG. 17, the locking button 250 may be used to secure and tie the right cord end and left cord end to the lower right pad 150 to secure the elastic resistance support together by weaving the right cord end and the left cord end through the plurality of button apertures 202 on the locking button 250.

In such an embodiment, multiple elastic cords 5 may be used—for example, a first elastic cord may secure the anchor plate 1 to the lower pads, while a second elastic cord may secure the lower right pad 150 to the lower left pad 160, as seen in FIGS. 12-17.

Optionally, one elastic cord 5 may be used to secure all shoulder pads and thigh pads together.

Figure 19:
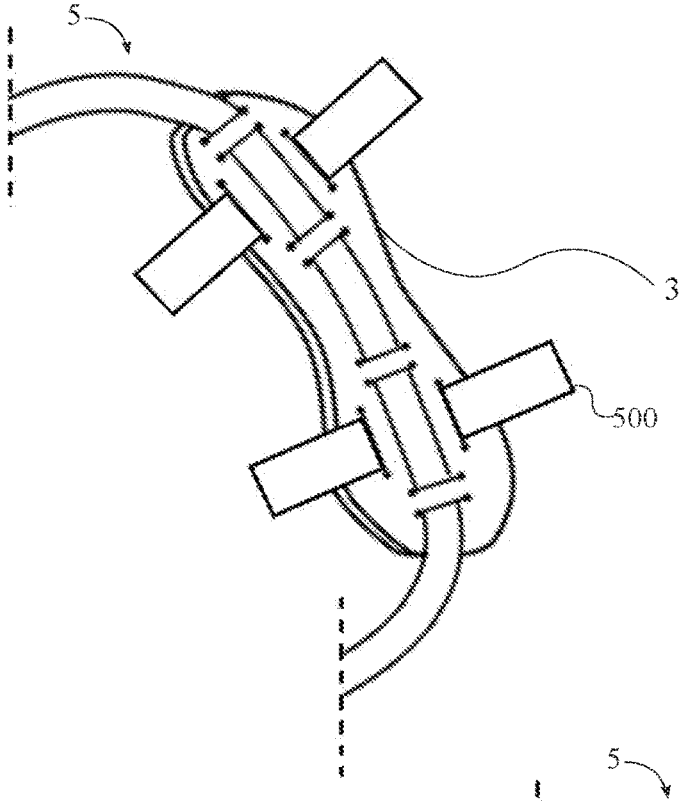
FIG. 19 is an enlarged front view showing the fastening mechanism on the shoulder pads.
Figure 19:
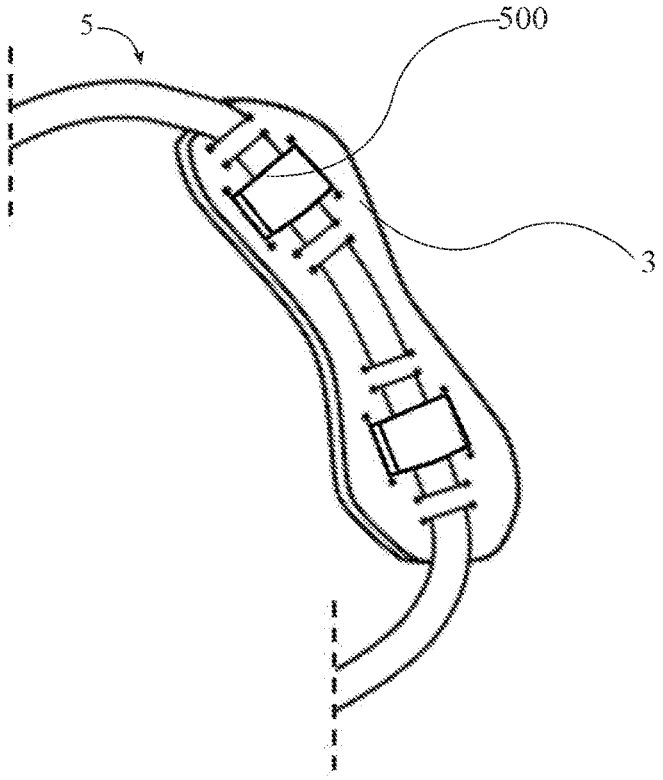
Figure 20:
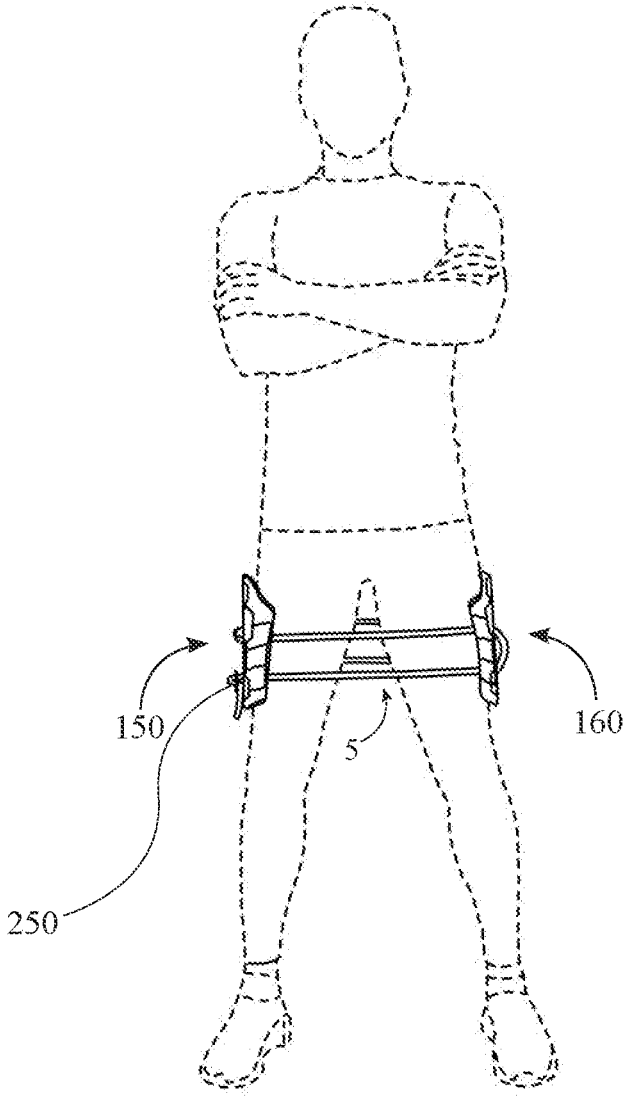
FIG. 20 is a front view of the leg pads in an operative configuration worn by a user.
Figure 21:
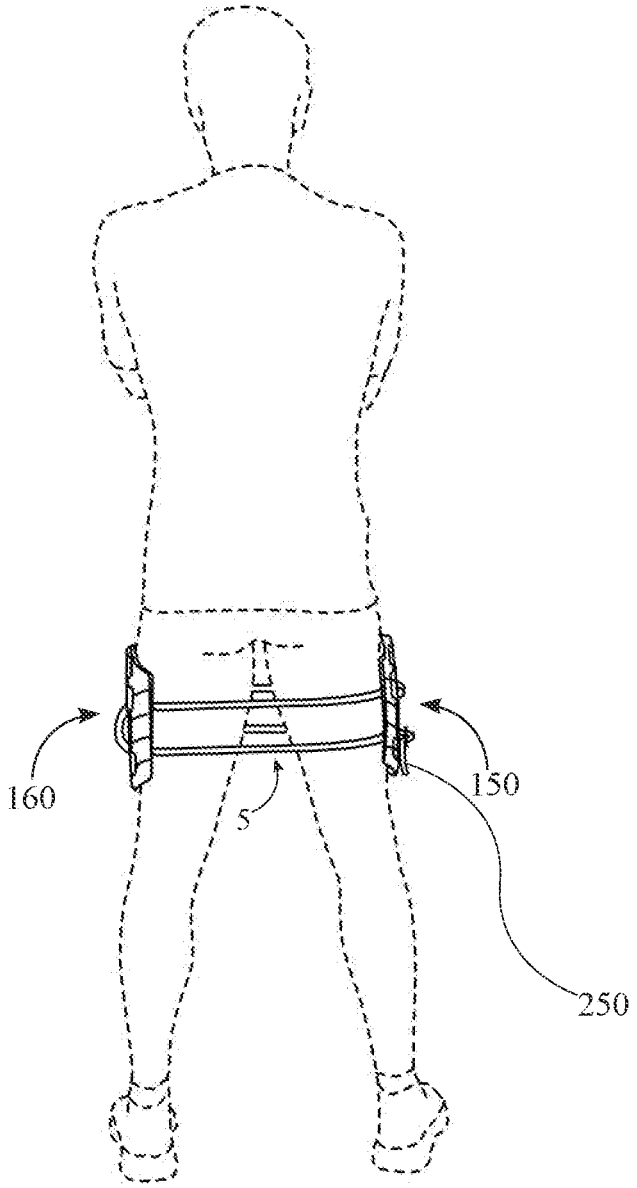
FIG. 21 is a back view of the leg pads in an operative configuration worn by a user.
Figure 22:
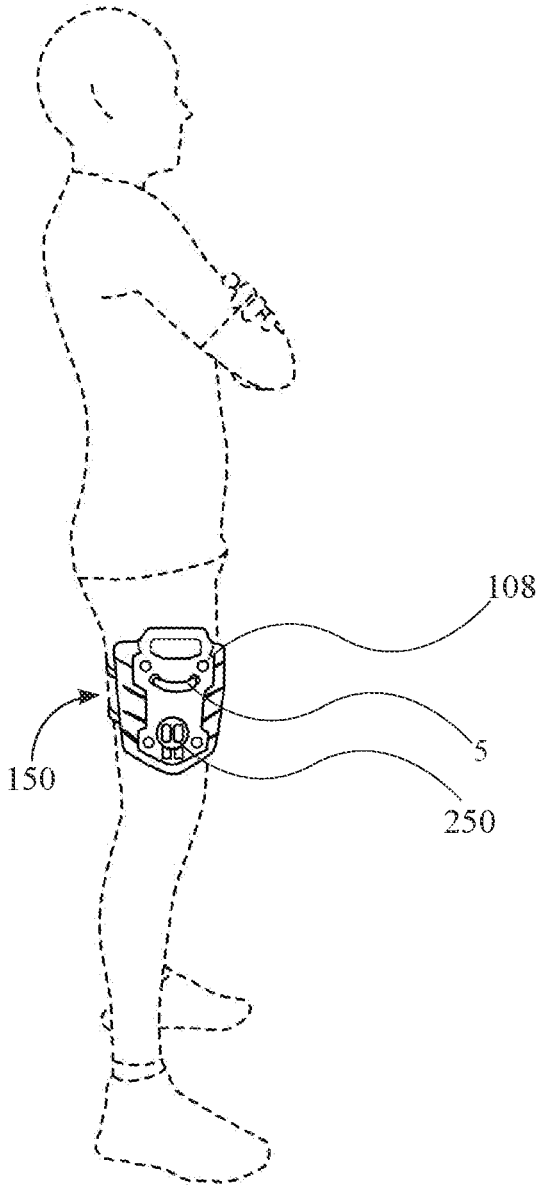
FIG. 22 is a right side view of the leg pads in an operative configuration worn by a user.

In one embodiment, as seen in FIG. 19, the left shoulder pad 3 and right shoulder pad 4 may further comprise a fastening loop 500. The fastening loop 500 may be made from any suitable material that facilitates the attachment of accessories, such as hook and loop or a similar material having adhesive properties. The fastening loop 500 is designed to allow accessories such as back backs and other should pads to be attached the left shoulder pad 3 and right shoulder pad 4 for more secure attachment when the elastic resistance support is in a state of use.

The elastic cord 5 may further comprise a nylon weave that protects users from risk of overextension. The nylon weave may be adhered to the outside of the elastic cord 5 giving extra resistance to help in the exercise process. The pitch of the braiders of the nylon weave can be adjusted to allow for a tighter or looser weave, as desired by the user. This ensures there is a simple way to adjust the grade of the support to raise or lower resistance. In an ideal embodiment, the nylon weave may be 45% lose and 35% tight, though other configurations are within the spirit and scope of the invention.

Figure 23:
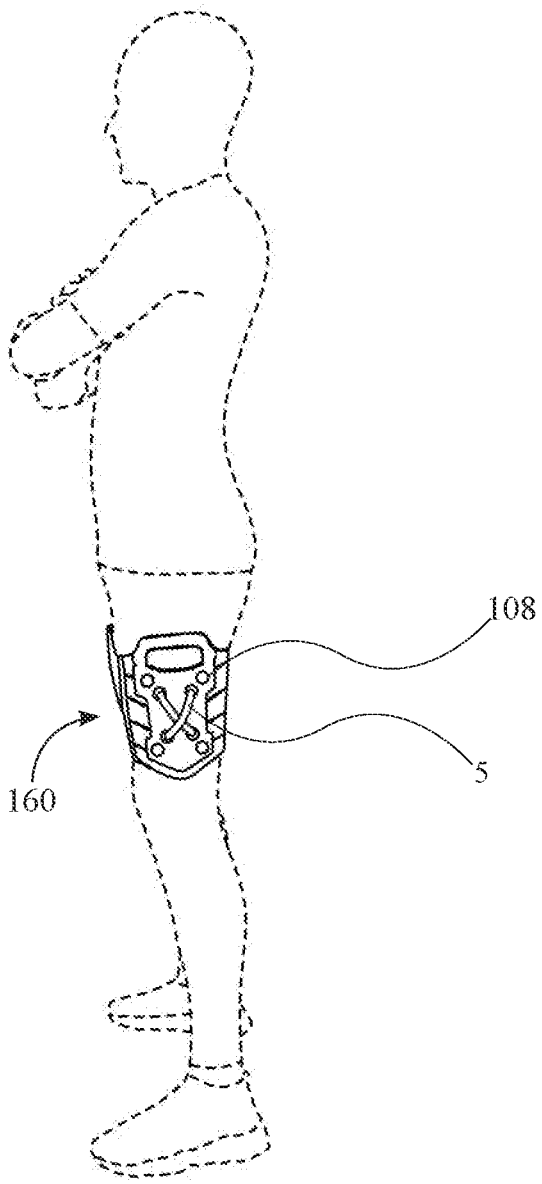
FIG. 23 is a left side view of the leg pads in an operative configuration worn by a user.
Figure 24:
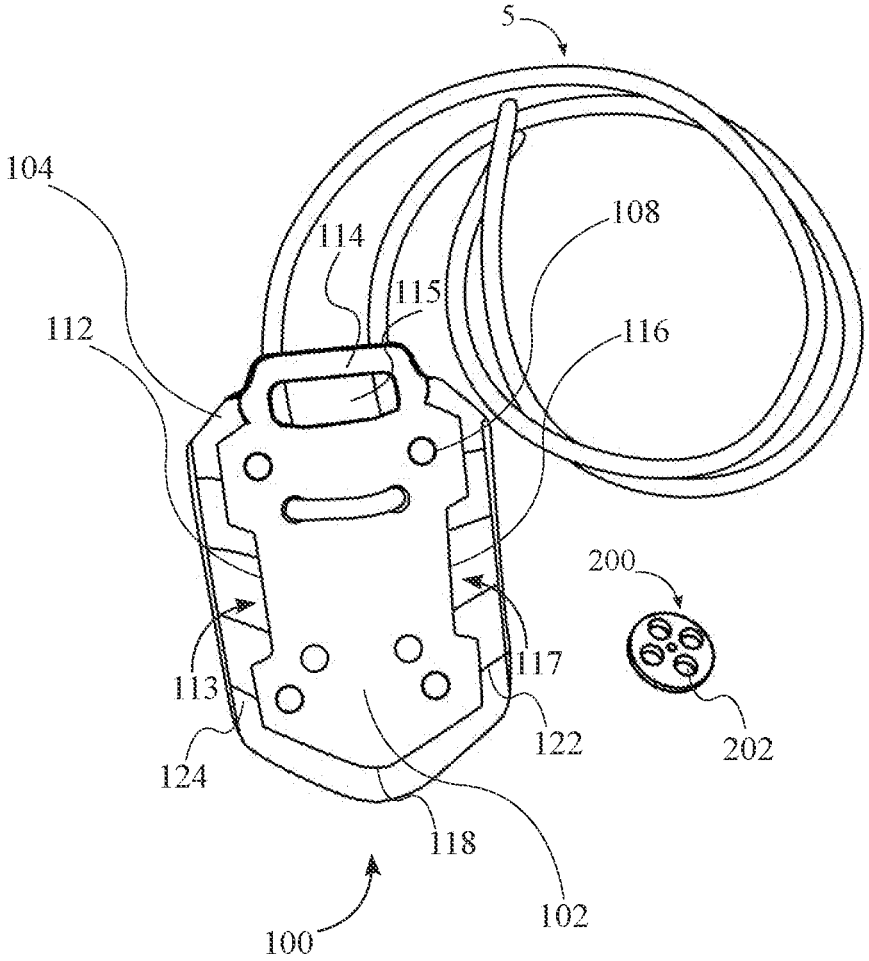
FIG. 24 is a perspective view of a leg pad in a first step of assembly.
Figure 25:
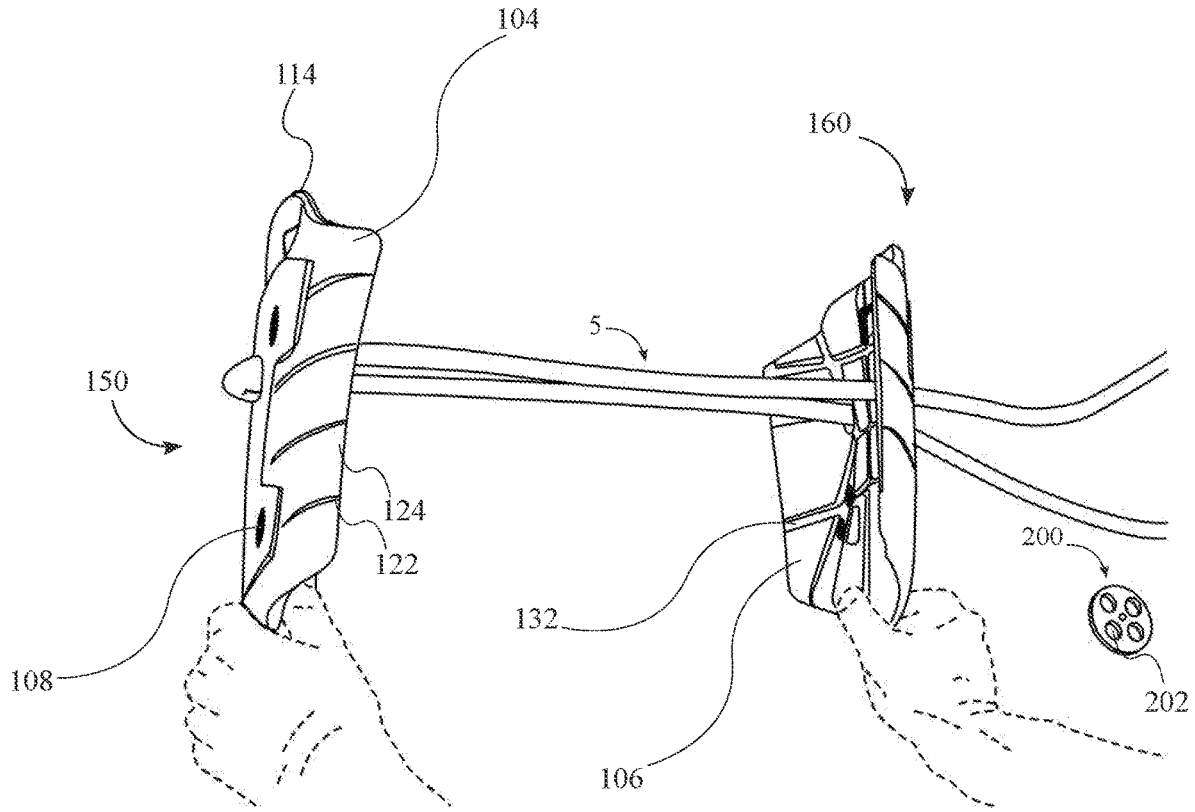
FIG. 25 is a perspective view of the leg pads in a second step of assembly.
Figure 26:
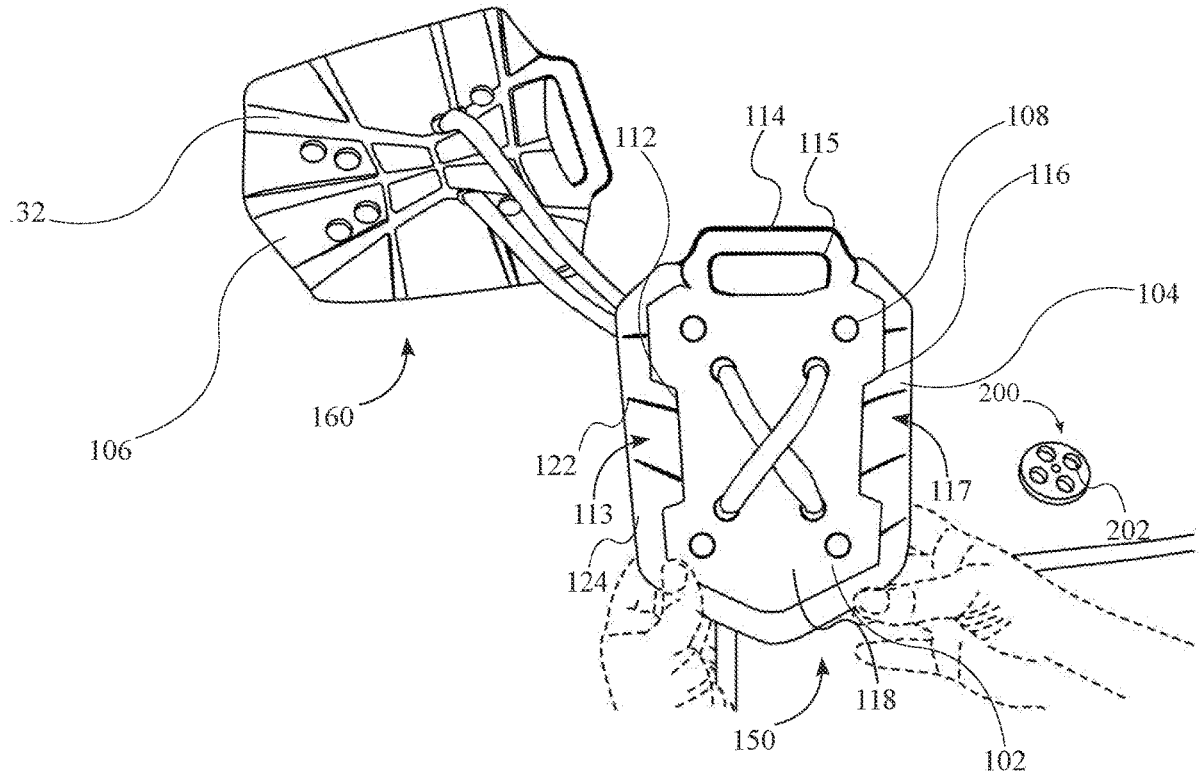
FIG. 26 is a perspective view of the leg pads in a third step of assembly.
Figure 27:
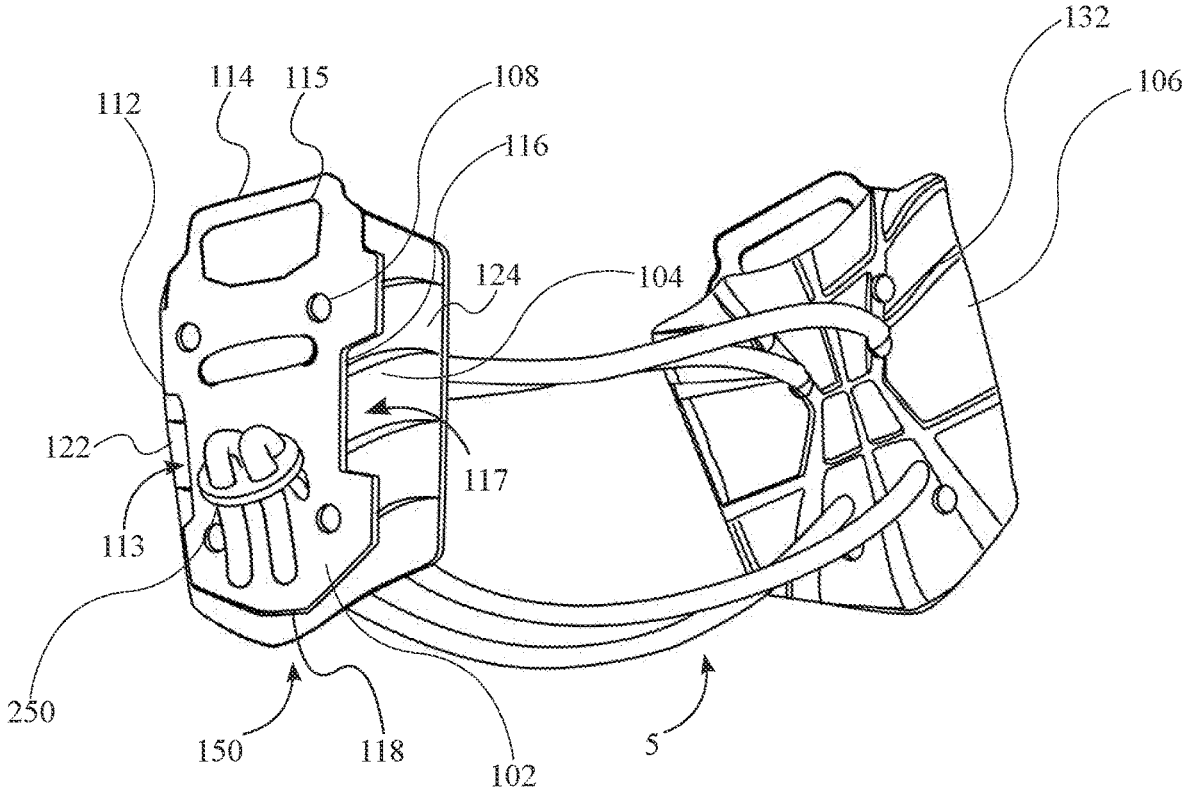
FIG. 27 is a perspective view of the leg pads in a final step of assembly.

In the preferred embodiment of the present invention, the elastic resistance support is assembled by the following steps: a first segment of the elastic cord 5 enters through a first aperture of the plurality of pad apertures 108 of the lower right pad 150, as shown in FIG. 23-24. Secondly, the first segment of the elastic cord 5 loops around the lower right pad 150 and comes out a second aperture of the plurality of pad apertures 108 of the lower right pad 150 as shown in FIG. 24. Both the first segment and second segment of the elastic cord 5 enter through one of the plurality of pad apertures 108 of the lower left pad 160 as shown in FIG. 25. After that both the ends of the elastic cord 5 cross hatch around and exit through a second set of the plurality of pad apertures 108 of the lower left pad 160 as shown in FIG. 26. In order to tie the elastic resistance support together, both ends of the elastic cord 5 come out the remaining two pad apertures of the lower right pad 150, where the elastic cord 5 is tied securely with the locking button 250 as shown in FIG. 27. In this preferred embodiment, the lower right pad 150 and lower left pad 160 can be used independently of any upper body components of the support, and need not attach to any exterior components, fixtures, or arrangements to provide resistance to the user.

Although the invention has been explained in relation to its preferred embodiment, it is to be understood that many other possible modifications and variations can be made without departing from the spirit and scope of the invention as hereinafter claimed.

What is claimed is:

1. An elastic resistance support comprising:

at least one lower pad, the at least one lower pad comprising:

a first section;

a second section;

a third section;

a plurality of pad apertures;

at least one button, the at least one button comprising a plurality of button apertures;

wherein the at least one button comprises a locking button;

a first elastic cord;

wherein the first elastic cord is configured to weave through the plurality of button apertures of the locking button and the plurality of pad apertures to secure the elastic cord to the at least one lower pad;

wherein the first section of the at least one pad comprises a first arc, a second arc, a third arc, and a bevel;

the first arc being positioned opposite the third arc;

the bevel being positioned opposite the second arc; and wherein the second arc further comprises an upper aperture.

2. The elastic resistance support of claim 1, wherein:

the at least one lower pad further comprises a first lower pad and a second lower pad;

the first lower pad being configured to slidably connected to the second lower pad using the first elastic cord; and the first elastic cord being configured to weave through the plurality of pad apertures of the first lower pad, the plurality of pad apertures of the second lower pad, and the plurality of button apertures of the locking button to slidably connect the first lower pad and the second lower pad.

3. The elastic resistance support of claim 2, further comprising:

an anchor plate;

a support cushion;

a second elastic cord;

a plurality of eyelets;

the plurality of eyelets being mounted in between the anchor plate and the support cushion;

an opening for each of the plurality of eyelets being oriented parallel to the anchor plate;

the plurality of eyelets being configured to weave the second elastic cord into a left loop portion, a right loop portion, a left cord end, and a right cord end;

the left loop portion being positioned adjacent to the anchor plate;

the right loop portion being positioned adjacent to the anchor plate, opposite the left loop portion;

the left cord end and the right cord end being positioned adjacent to each other; and the left cord end and the right cord end being positioned in between the left loop portion and the right loop portion.

4. The elastic resistance support of claim 3, further comprising:

a locking fixture comprising:

a first lower left button;

a second lower left button;

a first lower right button;

a second lower right button;

wherein the first lower left button and second lower left button are positioned along the left loop portion;

wherein the first lower right button and second lower right button are positioned along the right loop portion;

wherein the first lower pad is slidably connected to the anchor plate by the second elastic cord; and wherein the second lower pad is slidably connected to the anchor plate by the second elastic cord.

5. The elastic resistance support as claimed in claim 4, further comprising:

a first handle; and the first handle being terminally connected to the second elastic cord at the left cord end.

6. The elastic resistance support as claimed in claim 5, further comprising:

a second handle; and the second handle being terminally connected to the second elastic cord at the right cord end.

7. The elastic resistance support as claimed in claim 3 further comprising:

the plurality of eyelets comprises a first left eyelet, a second left eyelet, a first right eyelet, a second right eyelet, a first bottom eyelet, and a second bottom eyelet;

the first left eyelet and the first right eyelet being positioned offset from each other across the anchor plate;

the second left eyelet and the second right eyelet being positioned offset from each other across the anchor plate;

the first left eyelet and the first right eyelet being positioned offset from the second left eyelet and the second right eyelet across the anchor plate;

the first bottom eyelet being positioned adjacent to the second left eyelet; and the second bottom eyelet being positioned adjacent to the second right eyelet.

8. The elastic resistance support as claimed in claim 7 further comprising:

the first left eyelet and the first right eyelet being positioned offset from each other across the anchor plate by a first distance;

the second left eyelet and the second right eyelet being positioned offset from each other across the anchor plate by a second distance; and the first distance being smaller than the second distance.

9. The elastic resistance support as claimed in claim 7 further comprising:

the opening of the first left eyelet and the opening of the second left eyelet being oriented at a left acute angle with each other;

the opening of the first right eyelet and the opening of the second right eyelet being oriented at a right acute angle with each other;

the left acute angle and the right acute angle being equal to each other; and the opening of the second left eyelet and the second right eyelet being positioned collinear to each other.

10. The elastic resistance support as claimed in claim 7 further comprising:

the opening of the second left eyelet and the opening of the first bottom eyelet being oriented perpendicular to each other;

the opening of the second right eyelet and the opening of the second bottom eyelet being oriented perpendicular to each other; and the opening of the first bottom eyelet and the opening of the second bottom eyelet being positioned parallel to each other.

11. The elastic resistance support as claimed in claim 7 further comprising:

the second elastic cord serially weaving through the first bottom eyelet, through the first left eyelet, through the second left eyelet, through the second right eyelet, through the first right eyelet, and through the second bottom eyelet.

12. The elastic resistance support as claimed in claim 4 further comprising:

the support cushion comprises a torso-bracing portion and at least one cleat;

the at least one cleat being centrally connected onto the torso bracing portion;

the at least one cleat being positioned amongst the plurality of eyelets; and the second elastic cord weaving through the plurality of eyelets and about the at least one cleat.

13. The elastic resistance support of claim 1, wherein:

the second section of the at least one lower pad comprises a plurality of grooves and a plurality of cells; and the third section of the at least one lower pad comprises a structural cross webbing.

14. The elastic resistance support of claim 1, wherein:

the at least one lower pad is convex in shape such that the at least one lower pad is adapted to conform to the shape of the thigh of a user.

15. The elastic resistance support as claimed in claim 1, further comprising:

the first arc further comprising a first indent;

the third arc further comprising a second indent; and wherein the first indent is positioned opposite the second indent.

16. An elastic resistance support comprising:

at least one lower pad, the at least one lower pad comprising:

a first section;

a second section;

a third section;

a plurality of pad apertures;

at least one button, the at least one button comprising a plurality of button apertures;

wherein the at least one button further comprises a locking button;

a first elastic cord;

wherein the first elastic cord is configured to weave through the plurality of button apertures of the locking button and the plurality of pad apertures to secure the first elastic cord to the at least one lower pad;

the second section of the at least one lower pad comprises a plurality of grooves and a plurality of cells;

the third section of the at least one lower pad comprises a structural cross webbing;

the first section of the at least one lower pad comprises a first arc, a second arc, a third arc, and a bevel;

the first arc being positioned opposite the third arc;

the bevel being positioned opposite the second arc;

wherein the second arc further comprises an upper aperture;

the first arc further comprising a first indent;

the third arc further comprising a second indent;

wherein the first indent is positioned opposite the second indent;

the at least one lower pad is convex in shape such that the at least one lower pad is adapted to conform to the shape of the thigh of a user;

the at least one lower pad further comprises a first lower pad and a second lower pad;

the first lower pad being configured to slidably connect to the second lower pad using the first elastic cord; and the first elastic cord being configured to weave through the plurality of pad apertures of the first lower pad, the plurality of pad apertures of the second lower pad, and the plurality of button apertures of the locking button to slidably connect the first lower pad and the second lower pad.

17. The elastic resistance support of claim 16, further comprising:

an anchor plate;

a support cushion;

a left shoulder pad;

a right shoulder pad;

a second elastic cord;

a plurality of eyelets;

the support cushion comprises a torso-bracing portion and at least one cleat;

the plurality of eyelets being mounted in between the anchor plate and the support cushion;

an opening for each of the plurality of eyelets being oriented parallel to the anchor plate;

the plurality of eyelets being configured to weave the second elastic cord into a left loop portion, a right loop portion, a left cord end, and a right cord end;

the left loop portion being positioned adjacent to the anchor plate;

the right loop portion being positioned adjacent to the anchor plate, opposite the left loop portion;

the left cord end and the right cord end being positioned adjacent to each other;

the left cord end and the right cord end being positioned in between the left loop portion and the right loop portion;

the left shoulder pad being slidably mounted along the left loop portion;

the right shoulder pad being slidably mounted along the right loop portion;

the at least one cleat being centrally connected onto the torso bracing portion;

the at least one cleat being positioned amongst the plurality of eyelets;

the second elastic cord weaving through the plurality of eyelets and about the at least one cleat;

the plurality of eyelets comprises a first left eyelet, a second left eyelet, a first right eyelet, a second right eyelet, a first bottom eyelet, and a second bottom eyelet;

the first left eyelet and the first right eyelet being positioned offset from each other across the anchor plate;

the second left eyelet and the second right eyelet being positioned offset from each other across the anchor plate;

the first left eyelet and the first right eyelet being positioned offset from the second left eyelet and the second right eyelet across the anchor plate;

the first bottom eyelet being positioned adjacent to the second left eyelet;

the second bottom eyelet being positioned adjacent to the second right eyelet;

the first left eyelet and the first right eyelet being positioned offset from each other across the anchor plate by a first distance;

the second left eyelet and the second right eyelet being positioned offset from each other across the anchor plate by a second distance;

the first distance being smaller than the second distance;

the opening of the first left eyelet and the opening of the second left eyelet being oriented at a left acute angle with each other;

the opening of the first right eyelet and the opening of the second right eyelet being oriented at a right acute angle with each other;

the left acute angle and the right acute angle being equal to each other;

the opening of the second left eyelet and the second right eyelet being positioned collinear to each other;

a first locking fixture;

a second locking fixture;

the first locking fixture comprising a first lower left button and a second lower left button;

the second locking fixture comprising a first lower right button and a second lower right button;

wherein the first lower left button and second lower left button are positioned along the left loop portion;

wherein the first lower right button and second lower right button are positioned along the right loop portion;

wherein the first lower pad is slidably connected to the anchor plate by the second elastic cord; and wherein the second lower pad is slidably connected to the anchor plate by the second elastic cord.

18. The elastic resistance support as claimed in claim 17 further comprising:

the opening of the second left eyelet and the opening of the first bottom eyelet being oriented perpendicular to each other;

the opening of the second right eyelet and the opening of the second bottom eyelet being oriented perpendicular to each other;

the opening of the first bottom eyelet and the opening of the second bottom eyelet being positioned parallel to each other; and the second elastic cord serially weaving through the first bottom eyelet, through the first left eyelet, through the second left eyelet, through the second right eyelet, through the first right eyelet, and through the second bottom eyelet.

19. The elastic resistance support as claimed in claim 17 further comprising:

a first handle;

a second handle;

the first handle being terminally connected to the second elastic cord at the left cord end; and the second handle being terminally connected to the second elastic cord at the right cord end.

* * * * *